US008348369B2

(12) United States Patent
Satoh et al.

(10) Patent No.: US 8,348,369 B2
(45) Date of Patent: Jan. 8, 2013

(54) IMAGE FORMING METHOD AND IMAGE FORMING APPARATUS

(75) Inventors: Taku Satoh, Kanagawa (JP); Yasunobu Takagi, Kanagawa (JP); Masakazu Yoshida, Kanagawa (JP); Takashi Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 382 days.

(21) Appl. No.: 12/706,408

(22) Filed: Feb. 16, 2010

(65) Prior Publication Data

US 2010/0207982 A1 Aug. 19, 2010

(30) Foreign Application Priority Data

Feb. 16, 2009 (JP) ..... 2009-032223
Dec. 16, 2009 (JP) ..... 2009-285580

(51) Int. Cl.
*B41J 29/38* (2006.01)

(52) U.S. Cl. ..... 347/12; 347/13; 400/56

(58) Field of Classification Search ..... 347/5, 9, 347/12, 14, 15, 19, 13; 400/56
See application file for complete search history.

(56) References Cited

U.S. PATENT DOCUMENTS

| | | | | |
|---|---|---|---|---|
| 7,284,918 | B2 * | 10/2007 | Nunokawa | 400/56 |
| 7,407,248 | B2 | 8/2008 | Hirano et al. | |
| 7,527,351 | B2 | 5/2009 | Hirano et al. | |
| 7,533,961 | B2 | 5/2009 | Kikuchi et al. | |
| 7,576,886 | B2 | 8/2009 | Kimura | |
| 7,600,842 | B2 | 10/2009 | Hirano et al. | |
| 2006/0092206 | A1 | 5/2006 | Kimura et al. | |
| 2006/0098232 | A1 | 5/2006 | Nakano et al. | |
| 2007/0058201 | A1 | 3/2007 | Ike et al. | |
| 2007/0064031 | A1 | 3/2007 | Nakano et al. | |
| 2007/0091135 | A1 | 4/2007 | Hosaka et al. | |
| 2007/0106962 | A1 | 5/2007 | Sakakibara et al. | |
| 2007/0211092 | A1 | 9/2007 | Shingyohuchi et al. | |
| 2007/0216953 | A1 | 9/2007 | Kikuchi et al. | |
| 2008/0117467 | A1 | 5/2008 | Hosaka et al. | |
| 2008/0123146 | A1 | 5/2008 | Ike et al. | |
| 2008/0137147 | A1 | 6/2008 | Nakano et al. | |
| 2008/0231904 | A1 | 9/2008 | Suzuki et al. | |
| 2009/0018881 | A1 | 1/2009 | Ito et al. | |
| 2009/0051734 | A1 | 2/2009 | Ike et al. | |
| 2009/0058910 | A1 | 3/2009 | Hatanaka et al. | |
| 2009/0167800 | A1 | 7/2009 | Hatanaka et al. | |
| 2009/0167804 | A1 | 7/2009 | Kikuchi et al. | |
| 2009/0195585 | A1 | 8/2009 | Satoh et al. | |

FOREIGN PATENT DOCUMENTS

| | | |
|---|---|---|
| JP | 2005-41008 | 2/2005 |
| JP | 2007-1269 | 1/2007 |
| JP | 2007-196490 | 8/2007 |

* cited by examiner

*Primary Examiner* — Lam S Nguyen
(74) *Attorney, Agent, or Firm* — Oblon, Spivak, McClelland, Maier & Neustadt, L.L.P.

(57) ABSTRACT

An image forming method includes discharging a droplet of a recording fluid via nozzles of a recording head onto a print medium; performing a main scan in which the print medium is scanned in a main scan direction; performing a sub-scan in which the print medium is scanned in a sub-scan direction; determining an overlap region in an image region that is formed by a single main scan; and performing an overlap control by forming an image in the overlap region through a plurality of main scans while the print medium is moved in the sub-scan direction by a feed amount L, wherein L=(n−x) d−md, where n is a number of the nozzles in the recording head; x is a number of the nozzles in the overlap region; d is a nozzle pitch; and m is a feed correcting coefficient (0<m<1).

6 Claims, 19 Drawing Sheets

IMAGE FORMING METHOD AND IMAGE FORMING APPARATUS

BACKGROUND OF THE INVENTION

1. Field of the Invention

The present invention generally relates to image forming methods and image forming apparatuses. More particularly, the invention relates to the reduction of a banding problem in an overlap region in a printed medium.

2. Description of the Related Art

There are various image forming apparatuses, such as printers, facsimile machines, copiers, and multifunction peripherals (MFP). An inkjet printer is one type of image forming apparatus that typically has a recording head configured to discharge a droplet of recording fluid (such as ink) onto a print medium, such as a sheet of paper, thereby forming an image on the print medium. The "print medium" is not limited to any particular material and may be herein referred to as a "sheet", a "recorded medium", "print medium", "transfer material", or "recording paper". To "form" an image is synonymous with "recording", "printing", "transferring", or "transcribing" an image by causing a recording fluid to attach to a print medium.

In an inkjet printer, the recording head may have multiple nozzles for discharging ink droplets in order to realize a high-speed printing (i.e., image-forming) operation. In a serial-type inkjet printer, ink droplets are discharged while the recording head is moved in a direction ("main-scan direction") perpendicular to a direction in which the print medium is transported ("sub-scan direction"). In order to achieve high image quality, a multi-pass method may be adopted, whereby the same region in the sheet is scanned in a main-scan direction more than once ("multiple scan") by the same group of nozzles or different groups of nozzles. However, the multi-pass method is subject to limited print speed due to its need to scan in two directions, i.e., the main-scan direction and the sub-scan direction. Thus, there is a need for increasing printing speed of an inkjet printer.

The printing speed of an inkjet printer may be increased by moving the recording head in only one direction (such as in the sheet-feeding direction). However, this requires a recording head having a width greater than the width of the sheet. Desirably, such a wide recording head should have the nozzles arranged in a row at certain intervals ("line type"). There is, however, a limit to the number of nozzles that can be provided to the recording head due to cost and manufacturing technology reasons. Thus, in many cases, a plurality of recording heads are used in combination, each recording head having a certain number of nozzles.

One problem associated with this solution is that those multiple recording heads can be joined together with only limited accuracy, and the nozzle-to-nozzle distance between adjacent recording heads cannot be made completely uniform. As a result, if the nozzle-to-nozzle distance is too large, a white line may be caused by a reduced amount of ink, while a dark line may be caused by excessive amount of ink if the nozzle-to-nozzle distance is too small. The appearance of such lines in the printed medium is referred to as "banding".

In order to prevent such banding phenomenon, an overlap may be provided at the joint of adjacent recording heads. An "overlap region" in the present disclosure refers to a region where more than one nozzle is assigned for generating a single dot. The overlap region may include a region that is scanned in the main-scan direction multiple times by a single recording head, or a region formed at a head-joint portion of a plurality of recording head members. However, in such an overlap region, because there are two or more nozzles corresponding to a dot according to data, the dot is produced by multiple nozzles unless some control is exerted, resulting in the development of banding due to increased density in the overlap region.

Japanese Laid-Open Patent Application No. 2005-41008 ("Patent Document 1"), for example, discloses a recording apparatus in which the sheet feed amount is varied when printing adjacent dots in the same main-scan line in the overlap region through different main-scan passes. However, the technology according to Patent Document 1 does not specify in which sub-scan direction the dots in the same main-scan line in the overlap region are shifted, and cannot prevent banding sufficiently.

SUMMARY OF THE INVENTION

Embodiments of the present invention may solve one or more problems of the conventional art.

In one aspect of the present invention, there is provided an image forming method for an image forming apparatus having a recording head with a plurality of nozzles. The image forming method includes discharging a droplet of a recording fluid via the nozzles of the recording head onto a print medium; performing a main scan in which the print medium is scanned by the recording head moving in a main scan direction; performing a sub-scan in which the print medium is scanned by the recording head by moving the print medium in a sub-scan direction; determining an overlap region in an image region formed by a single main scan; and performing an overlap control by forming an image in the overlap region through a plurality of main scans while the print medium is moved in the sub-scan direction by a feed amount L, wherein $L=(n-x)d-md$ where n is a number of the nozzles in the recording head; x is a number of the nozzles in the overlap region; d is a nozzle pitch; and m is a feed correcting coefficient ($0 \leqq m \leqq 1$).

In another aspect of the present invention, there is provided an image forming method for an image forming apparatus having a recording head with a plurality of nozzles. The recording head includes a plurality of recording head members disposed adjacent to one another. The image forming method includes discharging a droplet of a recording fluid via the nozzles of the recording head onto a print medium; performing a sub-scan in which the print medium is scanned by the recording head by moving the print medium in a sub-scan direction; shifting the recording head members with respect to one another such that a length of the recording head in the sub-scan direction becomes shorter, thereby forming an overlap region by overlapping ends of the recording head members, in which overlap region one or more of the nozzles in one recording head member are shifted with respect to one or more of the nozzles in the other recording head member by a distance equal to or less than a nozzle pitch d; and forming an image in the overlap region by discharging the droplet of the recording fluid via the nozzles in the overlap region.

In another aspect of the present invention, an image forming apparatus includes a recording head having a plurality of nozzles configured to discharge a droplet of a recording fluid onto a print medium; a recording head scan unit configured to move the recording head in a main-scan direction; a transport unit configured to transport the print medium in a sub-scan direction; and a print control unit configured to perform an overlap control by forming an image in an overlap region of an image region formed by a single main scan of the recording head. The image in the overlap region is formed by a plurality of main scans of the recording head by transporting the print medium in the sub-scan direction by a feed amount L, wherein L=(n−x)d−md where n is a number of the nozzles in the recording head; x is a number of the nozzles in the overlap region; d is a nozzle pitch; and m is a feed correcting coefficient ($0 \leqq m \leqq 1$).

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings exemplary constructions of the invention; however, the invention is not limited to the specific methods and instrumentalities disclosed. In the drawings.

DETAILED DESCRIPTION OF THE PREFERRED EMBODIMENTS

Figure 1:
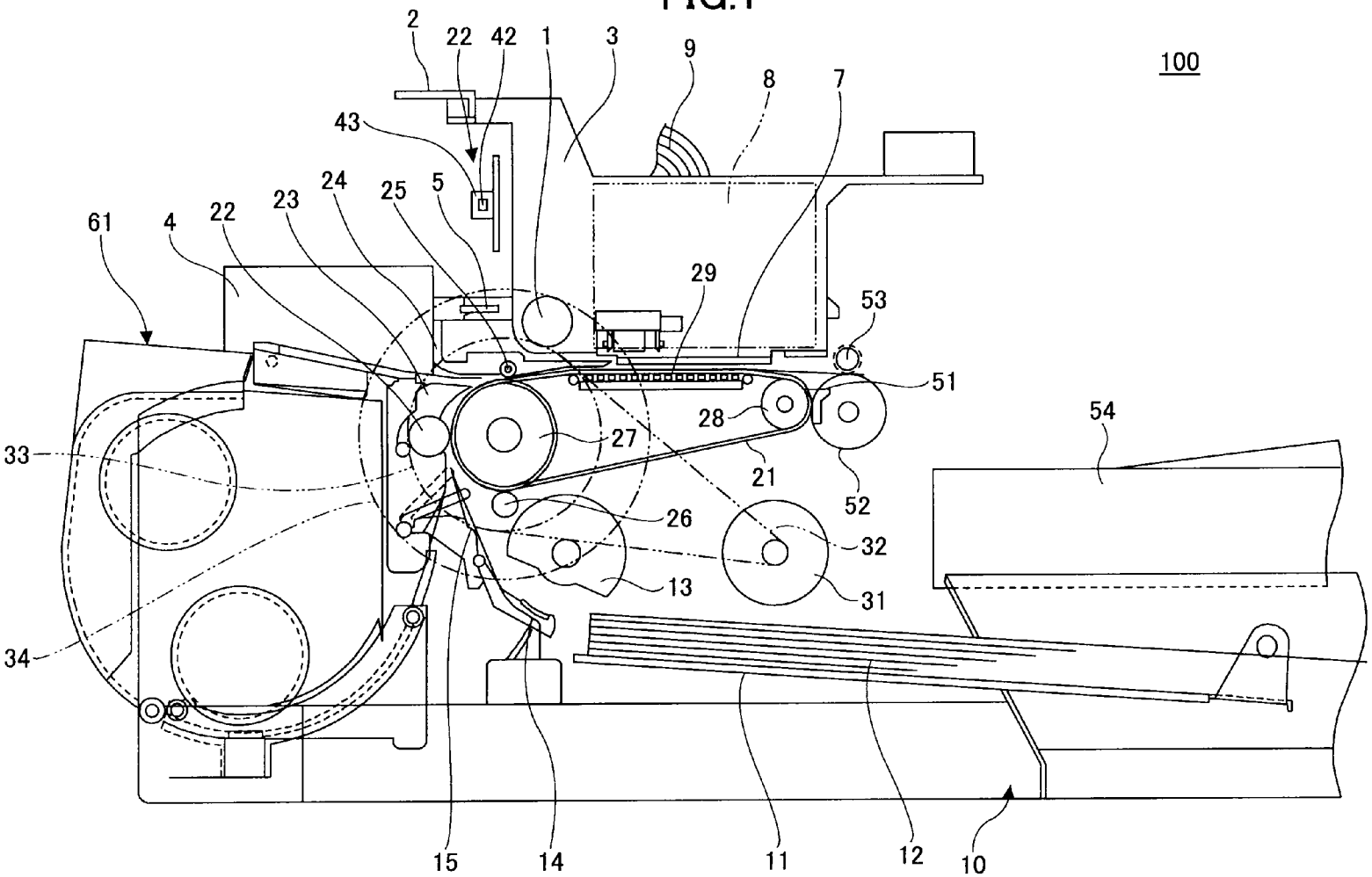
FIG. 1 is a side view of an image forming apparatus according to an embodiment of the present invention.

Referring now to the drawings, wherein like reference numerals designate identical or corresponding parts throughout the several views, embodiments of the present invention are described.

1. Structure of Image Forming Apparatus

Figure 2:
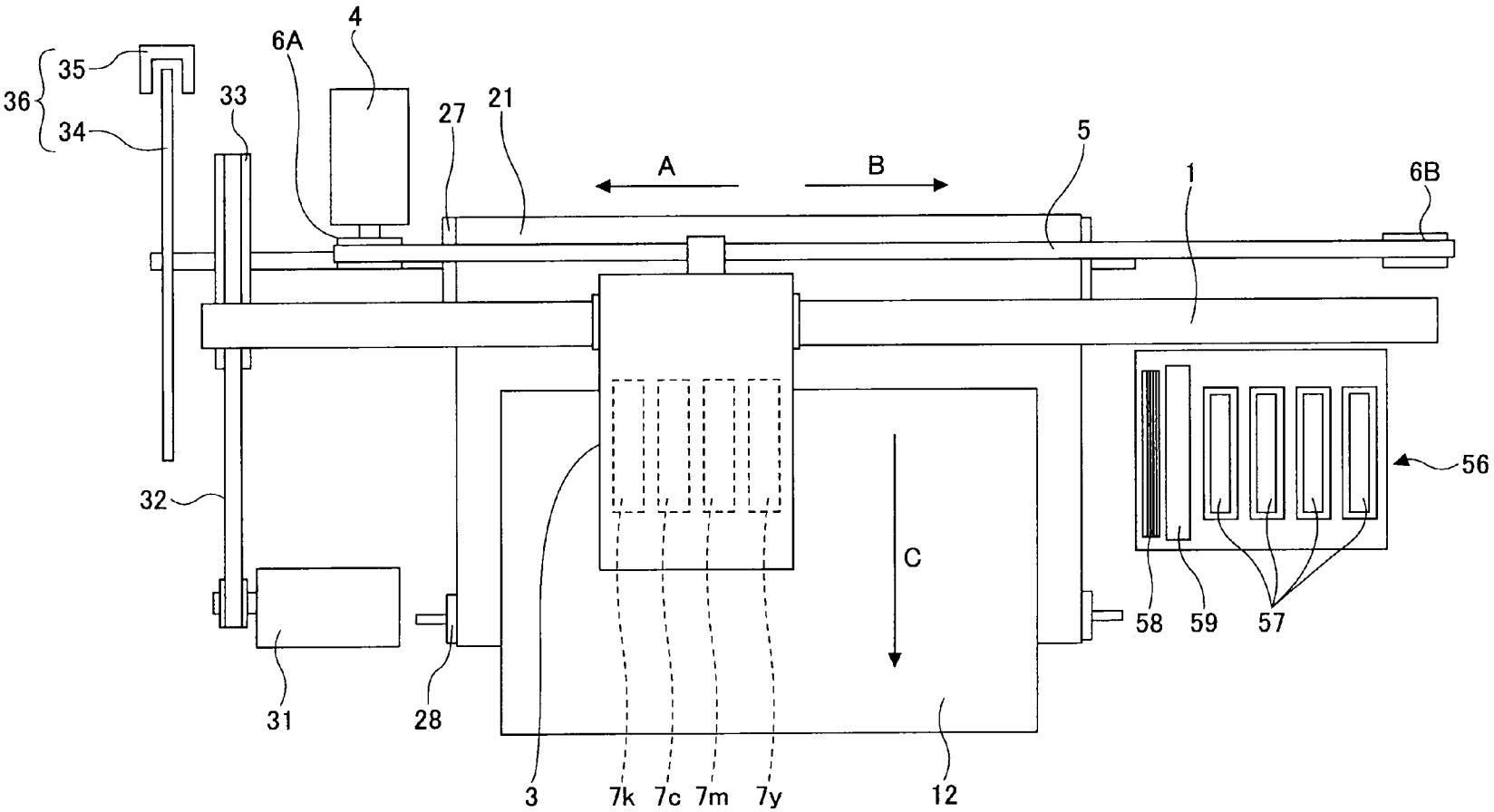
FIG. 2 is a plan view of the image forming apparatus of FIG. 1.

FIGS. 1 and 2 illustrate an image forming apparatus 100 according to an embodiment of the present invention. FIG. 1 is a side view of a mechanism portion of the image forming apparatus 100. FIG. 2 is a plan view of the mechanism portion. The image forming apparatus 100 includes side plates (not shown) between which a guide rod 1 and a guide rail 2 are laterally disposed, forming a guide unit. The guide rod 1 and the guide rail 2 support and guide a carriage 3 slidably in the main-scan directions indicated by arrows A and B. The carriage 3, which may be referred to as a recording head scan unit, is moved in the main-scan directions by a main-scan motor 4 via a timing belt 5 extended between a drive pulley 6A and a driven pulley 6B. The carriage 3 carries four recording heads 7*y*, 7*c*, 7*m*, and 7*k* for discharging ink droplets of the colors yellow (Y), cyan (C), magenta (M), and black (K), respectively. The recording heads 7*y*, 7*c*, 7*m*, and 7*k* may be collectively referred to as a "recording head 7" when no color distinction is required. The recording head 7 has a plurality of nozzles (ink discharge openings) arranged in a direction perpendicular to the main-scan direction, the ink discharge openings facing downwards so that ink droplets can be discharged in the downward direction. The carriage 3 also carries sub-tanks 8 for supplying the various colors of ink to the recording head 7. The sub-tanks 8 may be supplied with ink from a main tank or an ink cartridge (not shown) via an ink supply tube 9.

The recording head 7 (which may be referred to as a "fluid discharge head") may be constructed using various actuators as a pressure generating mechanism for producing the pressure for discharging ink droplets. Examples of the actuator includes a thermal actuator, a shape-memory alloy actuator, and an electrostatic actuator. The thermal actuator may employ an electro-thermal converter, such as a heat-generating resistor element, configured to utilize phase change by the film boiling of a fluid. The shape memory alloy actuator may utilize a metal phase change caused by a temperature change. The electrostatic actuator employs electrostatic force. Instead of providing an independent head structure for each color of ink, the recording head 7 may consist of a single head having a series of nozzles for discharging multiple colors of ink droplets. Alternatively, the recording head 7 may include a plurality of such heads.

The image forming apparatus 100 also includes a sheet-feeding unit configured to feed a sheet 12 stacked on a sheet stacking portion 11 (pressure plate) of a sheet-feeding cassette 10. The sheet-feeding unit may include a half-moon roller (sheet-feeding roller) 13 configured to feed the sheet 12 separately and individually from the sheet stacking portion 11, and a separating pad 14 disposed opposite the half-moon roller 13. The separating pad 14 is made of a material having a large coefficient of friction. The separating pad 14 is biased towards the sheet-feeding roller 13.

The sheet 12 fed by the sheet-feeding unit is then transported below the recording head 7 by a transport mechanism including a transport belt 21, a counter roller 22, a transport guide 23, a pressing roller 25, and a pressing member 24 biasing the pressing roller 25 towards the transport belt 21. The transport belt 21 is configured to transport the sheet 12 by electrostatically adsorbing the sheet 12 on it. The counter roller 22 is configured to transport the sheet 12 by holding it against the transport belt 21 as the sheet 12 is fed from the sheet-feeding unit via the guide 15. The transport guide 23 is configured to turn the sheet 12, as it is transported vertically upward, by substantially 90° so that the sheet 12 can follow the transport belt 21. The image forming apparatus 100 also includes a charging roller 26 which is a charging unit configured to charge the surface of the transport belt 21.

In accordance with the present embodiment, the transport belt 21 is an endless belt extended between a transport roller 27 and a tension roller 28. The transport roller 27 is rotated in a belt transport direction (sub-scan direction) indicated by an arrow C in FIG. 2, by a sub-scan motor 31 via a timing belt 32 and a timing roller 33. A guide member 29 is disposed at a position corresponding to an image forming region below the recording head 7, the guide member 29 contacting a back surface of the transport belt 21. The charging roller 26 is in contact with an upper layer of the transport belt 21 and is rotated by the rotation of the transport belt 21. A slitted circular plate 34 is mounted on an axle of the transport roller 27. The slitted circular plate 34 has a slit, whose position is detected by a sensor 35. The slitted circular plate 34 and the sensor 35 constitute a rotary encoder 36.

The sheet 12, after having been recorded by the recording head 7 in the image forming region is eventually ejected by an ejection unit into an ejected sheet tray 54. The ejection unit includes a separating nail 51 configured to separate the sheet 12 from the transport belt 21; and sheet-ejecting rollers 52 and 53.

Still referring to FIG. 2, the image forming apparatus 100 further includes a both-side sheet feeding unit 61 which is detachably installed in the back of the image forming apparatus 100. The both-side sheet feeding unit 61 is configured to receive the sheet 12 as it is fed back by an inverse rotation of the transport belt 21, invert the sheet 12, and then feed it back again between the counter roller 22 and the transport belt 21.

In a non-printed region on one side of the carriage 3 along the main-scan directions, a maintain/recover mechanism 56 is installed. The maintain/recover mechanism 56 is configured to maintain and recover a desired state of the nozzles of the recording head 7. The maintain/recover mechanism 56 includes caps 57 for capping the nozzle surfaces of the recording head 7; a wiper blade 58 which is a blade member configured to wipe the nozzle surfaces; and a blank discharge pan 59 configured to receive recording fluid droplets during a blank discharge operation. The blank discharge operation may be performed to discharge non-recording-contributing droplets via the nozzles in order to eject recording fluid with increased viscosity.

Thus, in the image forming apparatus 100, the sheet 12 is fed from the sheet-feeding unit one by one, guided vertically upward by the guide 15, and transported by being held between the transport belt 21 and the counter roller 22. The transport path of the sheet 12 is then changed by substantially 90° by the pressing roller 25 which holds the sheet 12 onto the transport belt 21, while the tip of the sheet 12 is guided by the transport guide 23. The charging roller 26 is supplied with a positive-negative alternating voltage from an AC bias supply unit (not shown) under the control of a control unit (not shown). As a result, the transport belt 21 is charged with an alternating charge voltage pattern consisting of bands with predetermined widths of alternating plus and minus polarities repeatedly appearing in the rotating direction, i.e., the sub-scan direction C. When the sheet 12 is fed onto the thus charged transport belt 21, the sheet 12 is adsorbed onto the transport belt 21 by an electrostatic force, so that the sheet 12 can be transported in the sub-scan direction C as the transport belt 21 rotates.

The recording head 7 is driven in accordance with an image signal while the carriage 3 is moved in the main-scan direction A or B, whereby ink droplets are discharged onto the sheet 12 when it is stationary to record a line of data on the sheet 12. The sheet 12 is then transported by a predetermined amount ("sheet feed amount"), followed by the recording of the next line. The recording operation may be stopped upon reception of a recording end signal or a signal indicating that the rear end of the sheet 12 has reached the recording region. The sheet 12 is eventually ejected onto the ejected sheet tray 54.

In the case of a double-side printing, the transport belt 21 is inversely rotated at the end of recording on the upper surface (which is initially printed), whereby the recorded sheet 12 is fed into the both-side sheet feeding unit 61. The both-side sheet feeding unit 61 inverts the sheet 12 (so that the back surface can be next printed), and feeds the sheet 12 back again between the counter roller 22 and the transport belt 21. The sheet 12 is transported by the transport belt 21 with an appropriate timing control exerted by the control unit, has its back surface recorded in the same manner as described above, and then ejected into the ejected sheet tray 54.

During a print standby period, the carriage 3 is moved to the maintain/recover mechanism 56, where the nozzle surfaces of the recording head 7 are capped with the caps 57 in order to maintain a desired wet condition of the nozzles, thereby preventing a discharge defect due to the drying of ink. Further, a recovery operation may be performed, in which the recording fluid is sucked out of the nozzles with the nozzles capped with the caps 57, in order to eject recording fluid with increased viscosity or air bubbles. Ink that has attached to the nozzle surfaces of the recording head 7 during the recovery operation is removed by a wiping operation involving the wiper blade 58. Prior to or during the recording operation, a blank discharge operation may be performed to eject ink that does not contribute to recording. By these maintenance and recovery operations, a stable discharge performance of the recording head 7 can be maintained.

While the foregoing description is directed to a serial-type image forming apparatus, the present invention may be embodied in a line-type image forming apparatus, in which a recording head having a length that is substantially equal to the width of a recorded medium is disposed in a direction perpendicular to the transport direction of the recorded medium.

Figure 3:
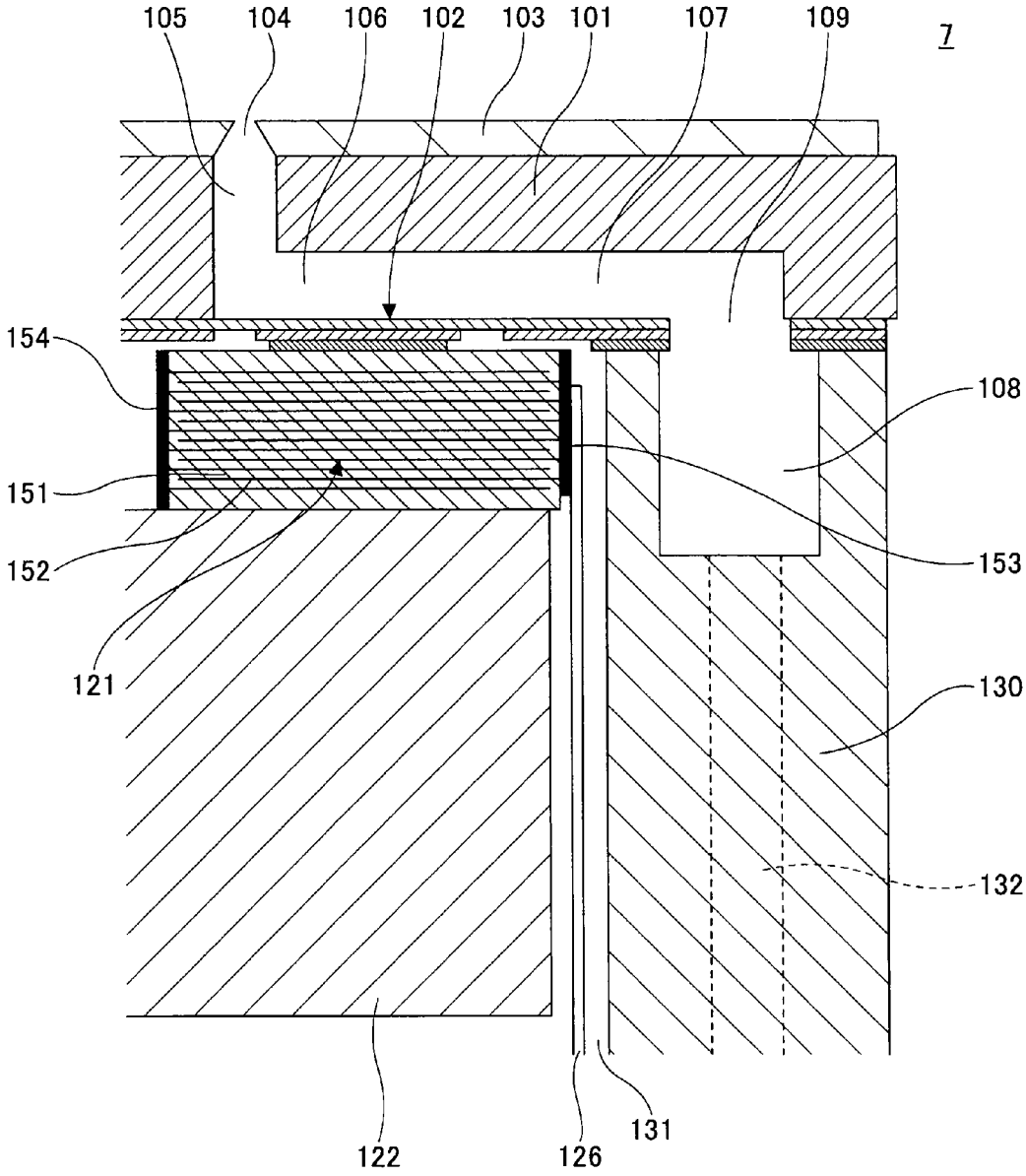
FIG. 3 is a cross section of a recording head of the image forming apparatus, taken along a longitudinal direction of a fluid chamber of the recording head.
Figure 4:
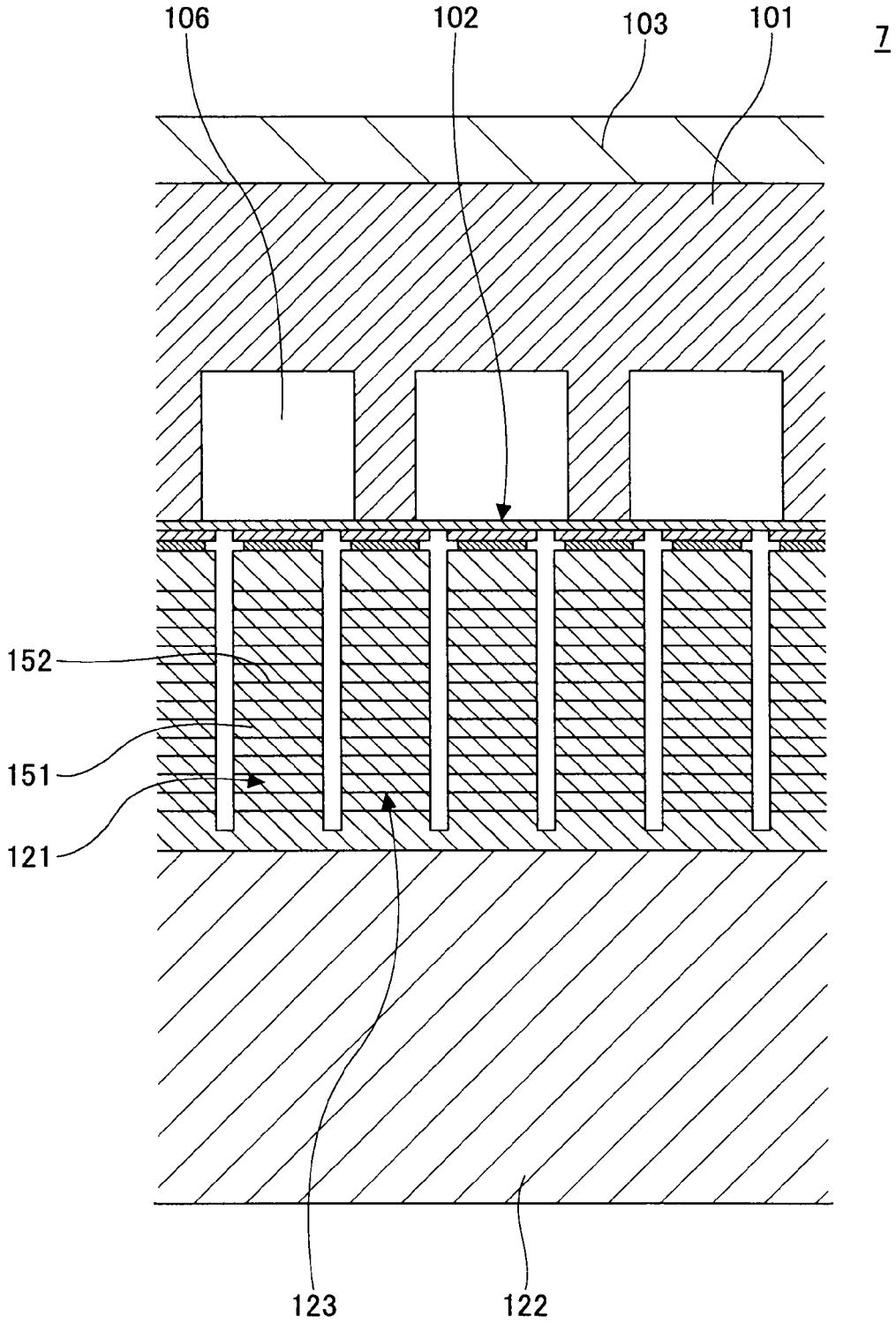
FIG. 4 is a cross section of the recording head taken along a width direction of the fluid chamber of the recording head.

Hereafter, the recording head 7 (fluid discharge head) is described with reference to FIGS. 3 and 4. FIG. 3 is a cross section of the recording head 7 taken in a longitudinal direction of the recording head 7. FIG. 4 is a cross section of the recording head 7 taken in a width direction of the recording head (along which the nozzles are arranged). The recording head 7 includes a fluid channel plate 101 which may be formed by anisotropic etching of a single crystal silicon substrate. A vibrating plate 102, which may be formed by electroforming of nickel, is joined to a lower surface of the fluid channel plate 101. A nozzle plate 103 is joined to an upper surface of the fluid channel plate 101. The laminate of the fluid channel plate 101, the vibrating plate 102, and the nozzle plate 103 contains the following: a nozzle communicating channel 105 communicated with a nozzle 104 via which droplets of recording fluid (ink droplets) are discharged; a fluid chamber 106 which is a pressure generating chamber; a fluid resistance portion (supply channel) 107; a common fluid chamber 108 for supplying the recording fluid; and an ink supply opening 109 communicated with the common fluid chamber 108 for supplying the recording fluid to the fluid chamber 106 via the fluid resistance portion 107.

The recording head 7 further includes two lines (only one line is illustrated in FIG. 3) of stacked piezoelectric elements 121 as a pressure generating unit (actuator unit) configured to deform the vibrating plate 102 so that the ink in the fluid chamber 106 can be pressurized. The piezoelectric element 121, which is an electro-mechanical transducer element, is fixedly bonded to a base substrate 122. Between the piezoelectric elements 121, support portions 123 are provided. The support portions 123, which may be formed simultaneously with the formation of the piezoelectric elements 121 by dividing a piezoelectric element material, merely provide a support because no drive voltage is applied to them. A FPC (flexible printed circuit) cable 126 is connected to the piezoelectric elements 121 from a drive circuit (drive IC), which is not illustrated.

A peripheral portion of the vibrating plate 102 is joined to the frame member 130. The frame member 130 defines a through-hole portion 131 in which the actuator unit including the piezoelectric element 121 and the base substrate 122 are contained. The frame member 130 also includes concave portions forming the common fluid chamber 108 and an ink supply opening 132 for externally supplying ink to the common fluid chamber 108. The frame member 130 may be formed by injection molding of a thermosetting resin, such as an epoxy resin or polyphenylene sulfide.

The fluid channel plate 101 may be formed by anisotropic etching of a single crystal silicon substrate with (110) crystal orientation, using an alkaline etching liquid, such as an aqueous solution of potassium hydroxide (KOH), thereby forming the concave portions or openings for the nozzle communicating channel 105 and the fluid chamber 106. The single crystal silicon substrate is merely an example. In other embodiments, the fluid channel plate 101 may be formed from other substrates or material, such as a stainless steel substrate or a photosensitive resin material.

The vibrating plate 102 may be made from a nickel plate by electroforming. In other examples, the vibrating plate 102 may be made from other metals or a metal/resin hybrid material. The piezoelectric element 121, the support portion 123, and the frame member 130 may be bonded to the vibrating plate 102 using adhesive. The nozzle 104 formed in the nozzle plate 103 is provided for each fluid chamber 106 and may have a diameter ranging from 10 μm to 30 μm. The nozzle plate 103 may be bonded to the fluid channel plate 101 using adhesive. In accordance with the present embodiment, a water-repellent layer is formed on an upper-most surface of a metal nozzle-forming member via any required layer.

The piezoelectric element 121 is a stacked piezoelectric element (PZT) in which a piezoelectric material 151 and internal electrodes 152 are alternately layered. The internal electrodes 152 are alternately drawn out to opposite end faces of the piezoelectric element 121 and connected to individual electrodes 153 or a common electrode 154. In accordance with the present embodiment, the ink in the fluid chamber 106 is pressurized by using displacement in d33 direction as a piezoelectric direction of the piezoelectric element 121. In another embodiment, displacement in d31 direction as a piezoelectric direction of the piezoelectric element 121 may be used to pressurize inside the pressure fluid chamber 106. In an embodiment, a line of the piezoelectric elements 121 may be provided to the substrate 122.

In such a structure of the fluid discharge head, a voltage applied to the piezoelectric element 121 may be decreased from a reference potential so as to contract the piezoelectric element 121. As the piezoelectric element 121 contract, the vibrating plate 102 moves downward, thereby expanding the volume of the fluid chamber 106 and thus causing the ink to flow into the fluid chamber 106. Thereafter, the voltage applied to the piezoelectric element 121 may be increased so as to extend the piezoelectric element 121 in the direction in which the internal electrodes 152 are stacked. As a result, the vibrating plate 102 is deformed in the direction of the nozzle 104, and the volume of the fluid chamber 106 decreases. The fluid chamber 106 is therefore pressurized, thereby causing the recording fluid in the fluid chamber 106 to be discharged (sprayed) out of the nozzle 104 in the form of a droplet.

The voltage applied to the piezoelectric element 121 is then returned to the reference potential, whereby the vibrating plate 102 restores its initial position and the fluid chamber 106 expands, producing a negative pressure in it. The negative pressure causes the fluid chamber 106 to be filled with recording fluid from the common fluid chamber 108. After the oscillation of the meniscus plane of the nozzle 104 has decayed and stabilized, an operation for discharging the next droplet is started.

The above described method (pull-push) of driving the recording head 7 is merely an example. In other embodiments, the recording head 7 may be driven by a pull method or a push method, depending on the way a drive waveform is applied to the recording head 7.

Figure 5:
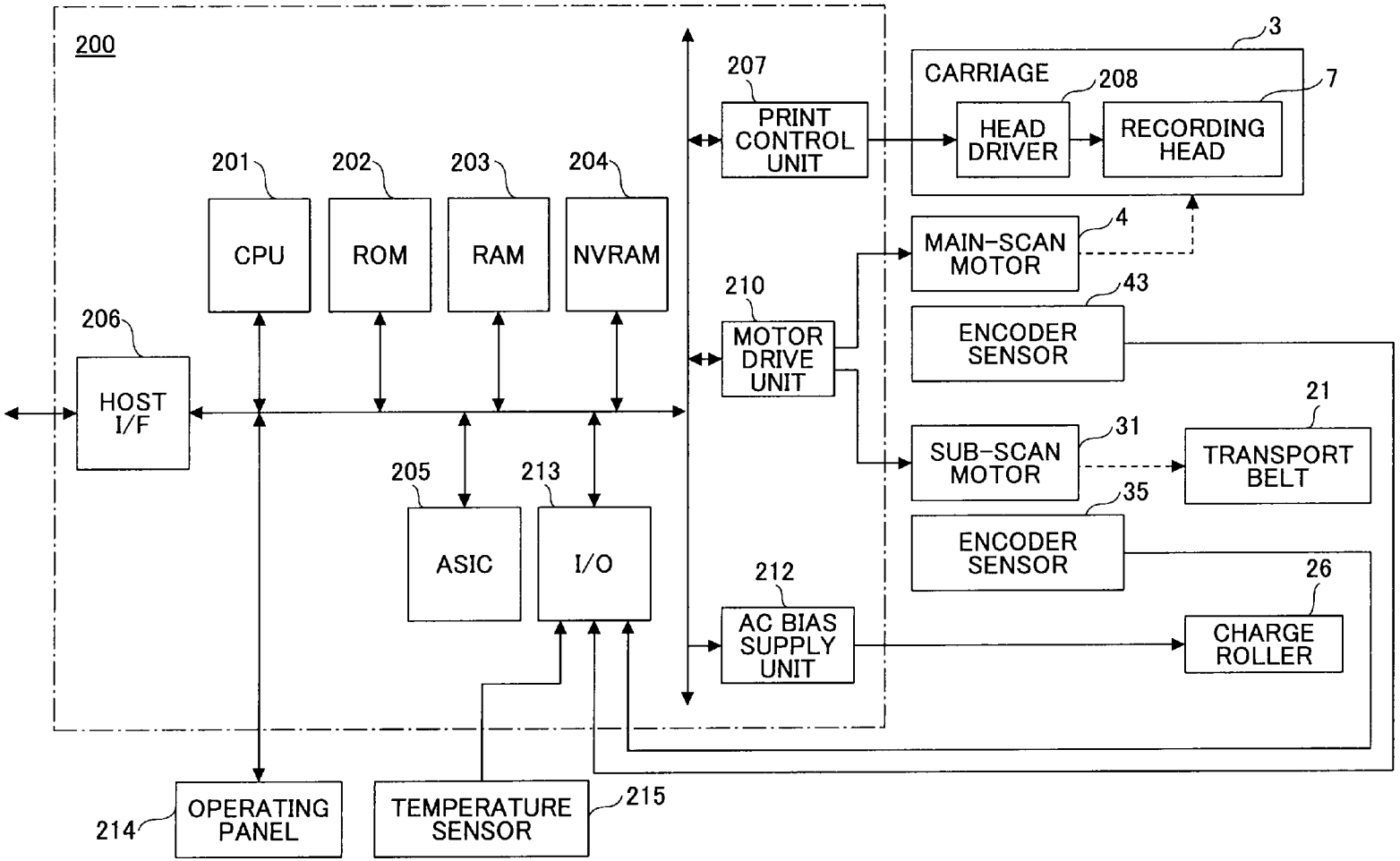
FIG. 5 is a block diagram of a control unit.

Hereafter, a control unit 200 of the image forming apparatus 100 is described with reference to a block diagram of FIG. 5. The control unit 200 includes a CPU 201 for controlling the apparatus as a whole; a ROM (read only memory) 202 in which a program executed by the CPU (central processing unit) 201 and other fixed data may be stored; a RAM (random access memory) 203 for temporal storage of image data and the like; a nonvolatile memory (NVRAM) 204 which is a rewritable memory that can retain data when power to the apparatus is turned off; and an ASIC (application specific integrated circuit) 205 configured to perform image processing, such as various signal processes on image data or a process involving rearrangement of image data. The ASIC 205 may also be configured to process input and output signals for controlling the apparatus as a whole.

The control unit 200 further includes a host I/F (interface) 206 for enabling transmission and reception of data or signal to or from a host; a data transfer unit for controlling the driving of the recording head 7; a print control unit 207 including a drive waveform generating unit configured to generate a drive waveform; a head driver (driver IC) 208 for driving the recording head 7 mounted on the carriage 3; a motor drive unit 210 for driving the main-scan motor 4 and the sub-scan motor 31; an AC bias supply unit 212 for supplying an AC bias to the charging roller 26; and an I/O 213 for enabling the input of detection signals from various sensors, such as detection signals from encoder sensors 43 and 35 or a temperature sensor (not shown) for detecting ambient temperature. Further, an operating panel 214 enabling the input and display of information necessary for the apparatus is connected to the control unit 200.

The control unit 200 may be configured to receive image data and the like from the host end, via a cable or a network and the I/F 206. The host end may include an information processing apparatus such as a personal computer, an image reading apparatus such as an image scanner, or an image capturing device such as a digital camera. The CPU 201 in the control unit 200 may be configured to read print data from a reception buffer in the I/F 206 and analyze the data. The ASIC 205 may perform necessary image processing, such as a process for rearranging image data. The processed image data is transferred from the head drive control unit 207 to the head driver 208. Dot pattern data for image output is generated by a printer driver on the host end, as will be described later.

The print control unit 207 may be configured to transfer the aforementioned image data to the head driver 208 as serial data. The print control unit 207 may also be configured to output various signals to the head driver 208, such as a transfer clock signal and a latch signal required for the transfer of the image data, or a droplet control signal (mask signal). The print control unit 207 also includes a drive waveform generating unit and a drive waveform selection unit (not shown). The drive waveform generating unit may include a D/A converter for D/A-converting drive signal pattern data stored in the ROM, a voltage amplifier, and a current amplifier. The drive waveform selection unit may be configured to select a drive waveform applied to the head driver. Thus, the print control unit 207 may generate a drive waveform consisting of one or more drive pulses (drive signals) and output the drive waveform to the head driver 208.

The head driver 208 is configured to drive the recording head 7 by selectively applying a drive signal to the drive element (such as the aforementioned piezoelectric element) that generates the energy for discharging ink droplets out of the recording head 7. The drive signal has a drive waveform fed from the print control unit 207 based on serially inputted image data corresponding to a line to be printed by the recording head 7. By selecting the drive pulse of which the drive waveform is constituted, the size of the dot produced by the ink droplet can be selected, such as a large droplet (for a large dot), an intermediate droplet (for an intermediate dot), or a small drop (for a small dot).

The CPU 201 calculates a drive output value (control value) applied to the main-scan motor 4 based on various values. The various values may be obtained by sampling a detection pulse from the encoder sensor 43 constituting a linear encoder, or from a speed/position profile stored in advance. The values obtained by sampling may include a speed detection value and a position detection value. The values obtained from the speed/position profile may include a target speed value and a target position value. The CPU 201 then drives the main-scan motor 4 via the motor drive unit 210 in accordance with the calculated control value for the main-scan motor 4. Similarly, the CPU 201 calculates a drive output value (control value) for the sub-scan motor 31 based on various values which may be obtained by sampling a detection pulse from the encoder sensor 35 constituting a rotary encoder, or from the speed/position profile stored in advance. The values obtained by sampling may include a speed target value and a position target value, and the values obtained from the speed/position profile may include a target speed value and a target position value. The CPU 201 then drives the sub-scan motor 31 via the motor drive unit 210 based on the calculated control value for the sub-scan motor 31.

Figure 6:
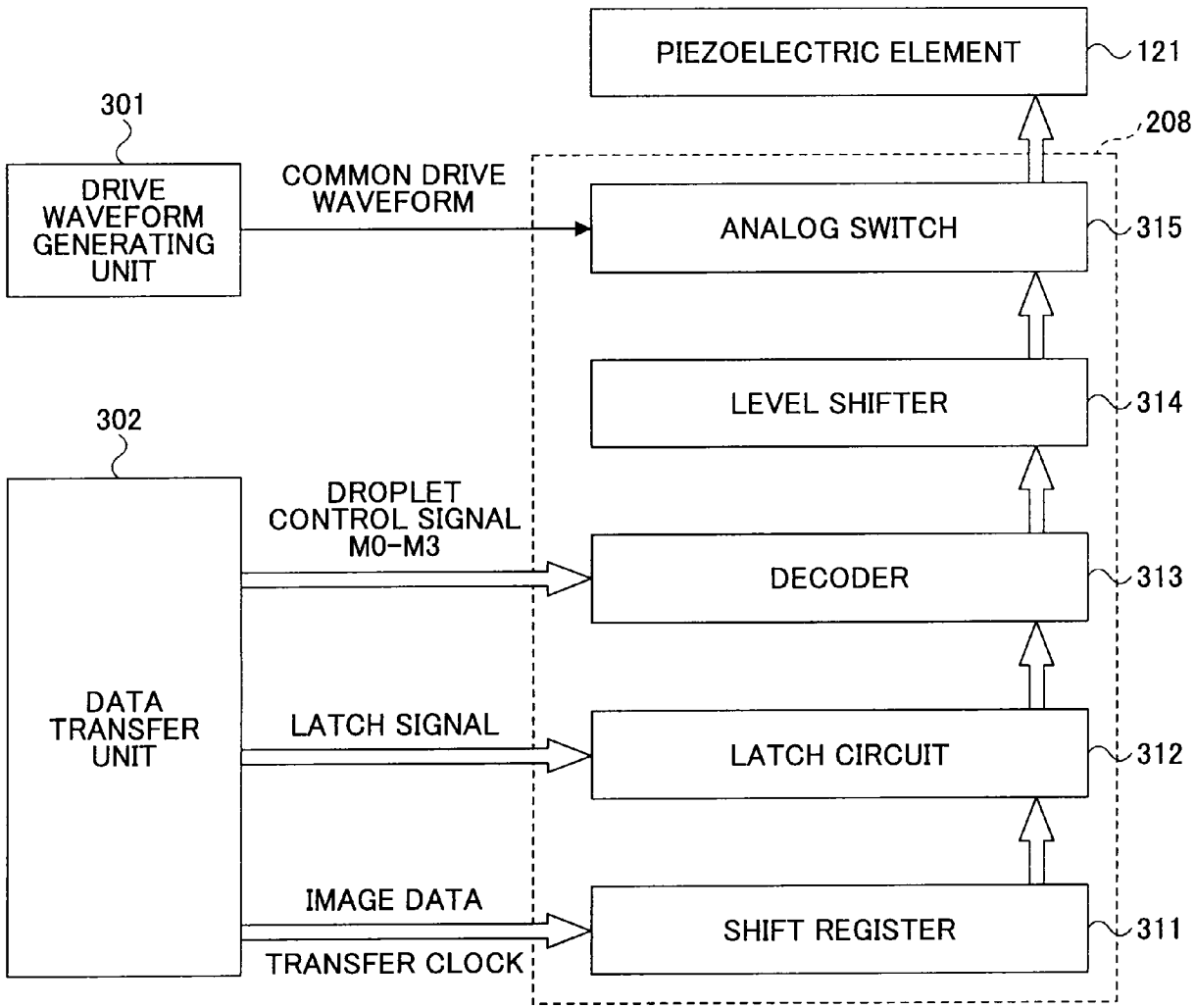
FIG. 6 is a block diagram of a print control unit.

Hereafter, the print control unit 207 and the head driver 208 are described with reference to FIG. 6. As mentioned above, the print control unit 207 includes the drive waveform generating unit 301 and the data transfer unit 302. The drive waveform generating unit 301 is configured to generate a drive waveform (common drive waveform) having a plurality of drive pulses (drive signals) in a print period. The data transfer unit 302 is configured to output 2-bit image data (gray level signals of 0s and 1s) corresponding to a printed image, a clock signal, a latch signal, and droplet control signals M0 through M3.

The droplet control signals are 2-bit signals for instructing the opening and closing of an analog switch 315 in the head driver 208 on a droplet by droplet basis. The droplet control signal transitions to a H level (ON) corresponding to a waveform to be selected, or to a L level (OFF) corresponding to a waveform that is not to be selected, in accordance with the print period of a common drive waveform.

The head driver 208 includes a shift register 311 to which a transfer clock (shift clock) and serial image data (gray level data: 2 bit/CH) are fed from the data transfer unit 302; a latch circuit 312 for latching a register value of the shift register 311 with the latch signal; a decoder 313 for decoding the gray level data and the control signals M0 to M3 and outputting a decoded result; a level shifter 314 for converting a logic level voltage signal from the decoder 313 into a level at which the analog switch 315 can operate; and the analog switch 315 that is turned on/off (opened/closed) by an output of the decoder 313 via the level shifter 314.

The analog switch 315 is connected to the selecting electrodes (individual electrodes) 154 of each piezoelectric element 121. A common drive waveform from the drive waveform generating unit 301 is supplied to the analog software 315. Thus, the analog switch 315 turns on depending on the result of decoding of the serially transferred image data (gray level data) and the control signals MN0 to MN3 by the decoder 313, so that a required drive signal having the common drive waveform is passed (selected) and applied to the piezoelectric element 121.

The ink used as a recording fluid in the image forming apparatus according to the present embodiment preferably has an ink composition including a pigment, a water-soluble organic solvent, polyol or glycol ether with carbon number of 8 or more, and water. Such a composition of ink provides high image quality even when printed on a normal sheet of paper. Specifically, the following advantageous properties can be obtained: (1) good color tone (with sufficient color development and color reproducibility); (2) high image density; (3) clear image quality without feathering phenomenon or color bleeding phenomenon in the printed character or image; (4) little ink strike-through, enabling double-side printing; (5) fast drying (fixing) property suitable for high speed print; and (6) high light and water resistance. Thus, by using the ink with the aforementioned composition, image density, color development, color reproducibility, and fixing property can be improved, and the problems of bleeding such as color edge bleeding can be prevented, thereby enabling double-side printing, for example.

Figure 7:
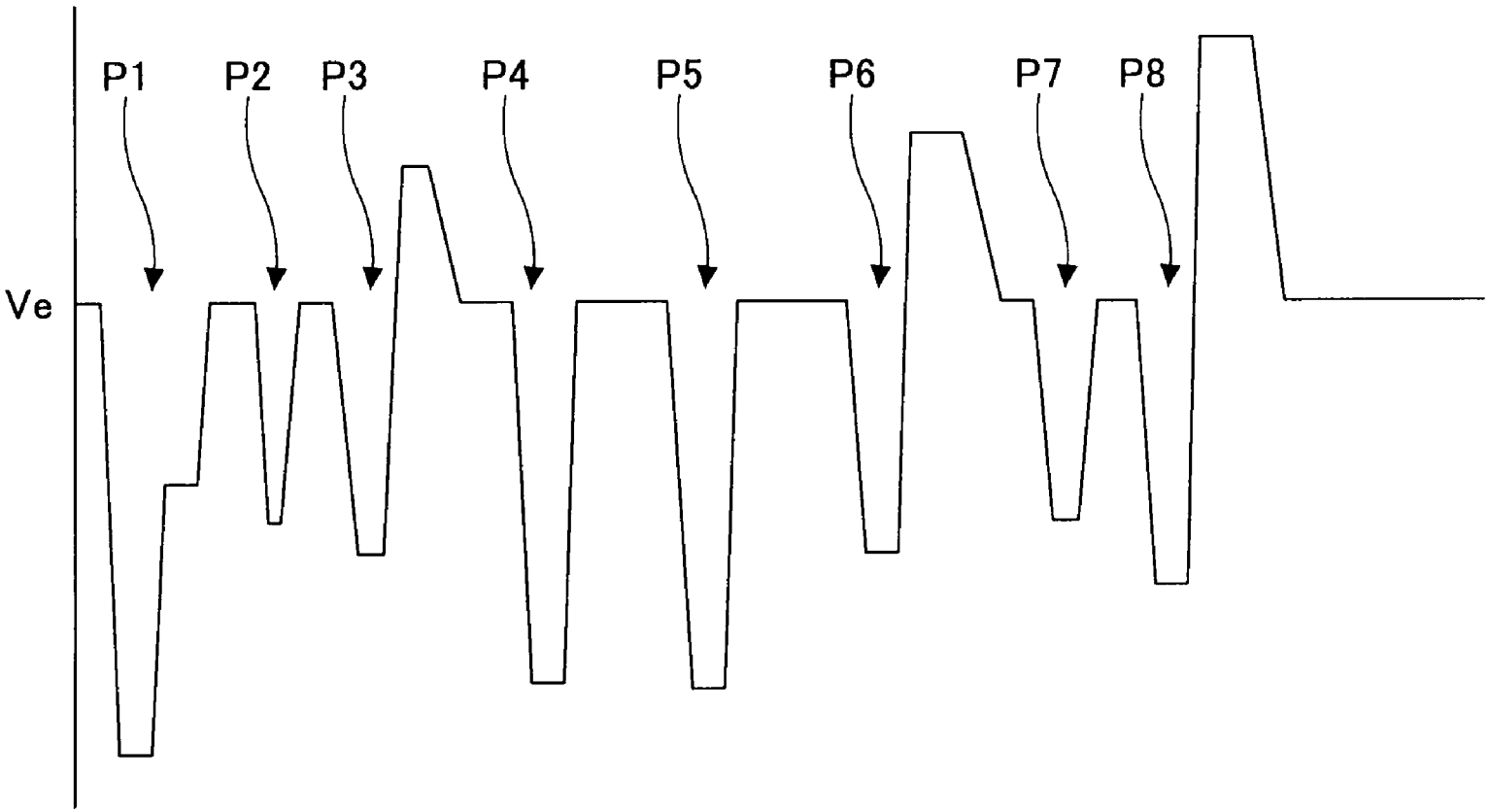
FIG. 7 illustrates a drive waveform generated by a drive waveform generating unit in the print control unit.

In the following, preferred examples of drive waveforms suitable for the aforementioned type of ink are described with reference to FIGS. 7 and 8(*a*) through 8(*c*). The drive waveform generating unit 301 generates a drive signal (drive waveform) consisting of eight drive pulses P1 through P8 in one print period (drive period) as depicted in FIG. 7. The pulses include waveform elements falling from a reference potential Ve and waveform elements rising from the fallen state. The drive pulse to be used is selected by the droplet control signals M0 through M3 from the data transfer unit 302.

In the drive pulses, the waveform elements whose potential V falls from the reference potential Ve are pull-waveform elements that cause contraction of the piezoelectric element 121 and therefore an increase in the volume of the pressure fluid chamber 106. The waveform elements that rise from the fallen state are pressurizing waveform elements that cause extension of the piezoelectric elements 121 and therefore a decrease in the volume of the pressure fluid chamber 106.

Figure 8:
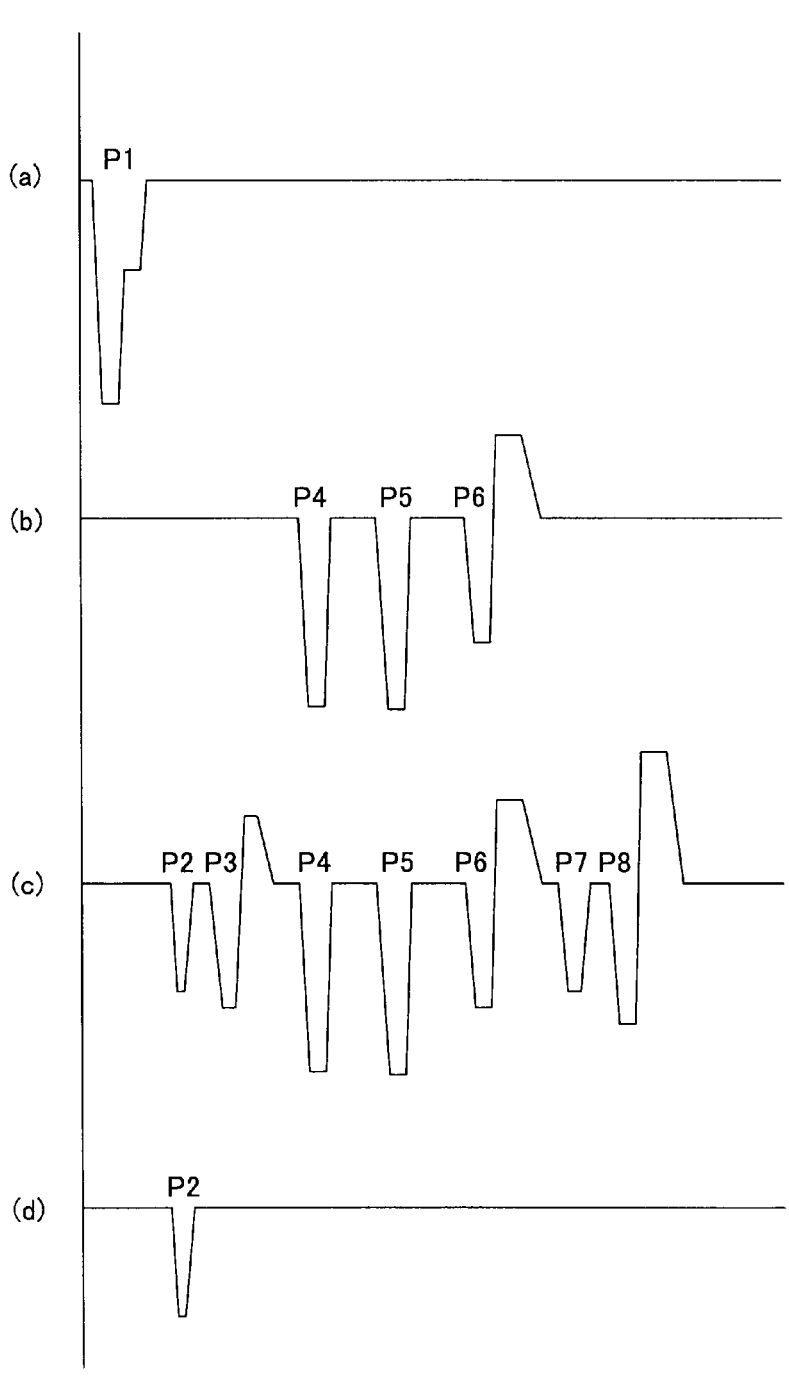
FIGS. 8(*a*) through 8(*c*) illustrate drive pulses for forming droplets of various sizes, and FIG. 8(*d*) illustrates a drive pulse for a fine drive operation.

When a small drop (small dot) is to be formed by the droplet control signals M0 through M3 from the data transfer unit 302, the drive pulse P1 (FIG. 8(*a*)) is selected. When an intermediate droplet (intermediate dot) is to be formed, the drive pulses P4 through P6 (FIG. 9(*b*)) are selected. When a large droplet (large dot) is to be formed, the drive pulses P2 through P8 (FIG. 8(*c*)) are selected. In the case of a fine drive operation (causing the meniscus to oscillate without discharging droplets), a fine drive pulse P2 (FIG. 8(*d*)) is selected. The selected pulses are applied to the piezoelectric element 121 in the recording head 7.

When forming the intermediate droplet, the first droplet is discharged by the drive pulse P4, the second droplet is discharged by the drive pulse P5, and the third droplet is discharged by the drive pulse P6 in such a manner that these droplets are joined during their flight into a single droplet that lands on the recording sheet. At this time, the interval of discharge timings of the drive pulses P4 and P5 is preferably 2Tc±0.5 μs, where Tc is the intrinsic oscillation period of the pressure chamber (fluid chamber 106). Because the drive pulses P4 and P5 are simple pull waveform elements, if the drive pulse P6 is also made a simple pull waveform element, the ink droplet speed may become excessive and may be shifted from the landing position of the other droplet types. Thus, the pull-in voltage of the drive pulse P6 is reduced (i.e., the fall potential is reduced) so that the meniscus can be pulled less and the ink droplet speed of the third droplet can be decreased. However, the rise voltage is not reduced in order to gain a necessary ink droplet volume.

Thus, the pull-in voltage of the pull-waveform element of the final drive pulse in the series of drive pulses is reduced so that the discharge speed of the droplet by the final drive pulse can be relatively reduced, thereby aligning the landing position of the final droplet with those of the other droplet types as much as possible.

The fine drive pulse P2 has a drive waveform that causes an oscillation of the meniscus without discharging an ink droplet, in order to prevent the drying of the meniscus in the nozzle. The fine drive pulse P2 is applied to the recording head 7 in the non-printed region. By utilizing the drive pulse P2, i.e., the fine drive waveform (see FIG. 8(*c*)) as one of the drive pulses for forming a large droplet, the drive period can be reduced (i.e., the print speed can be increased).

By setting the interval of discharge timing between the fine drive pulse P2 and the drive pulse P3 within a range of Tc (intrinsic oscillation period) ±0.5 μs, the volume of the ink droplet discharged by the drive pulse P3 can be increased. Specifically, by superposing the expansion of the pressure fluid chamber 6 by the drive pulse P3 on the pressure oscillation of the pressure fluid chamber 106 by using the oscillation period caused by the fine drive pulse P2, the volume of droplet that can be discharged by the drive pulse P3 can be made greater than when the drive pulse P3 alone is applied.

Figure 9:
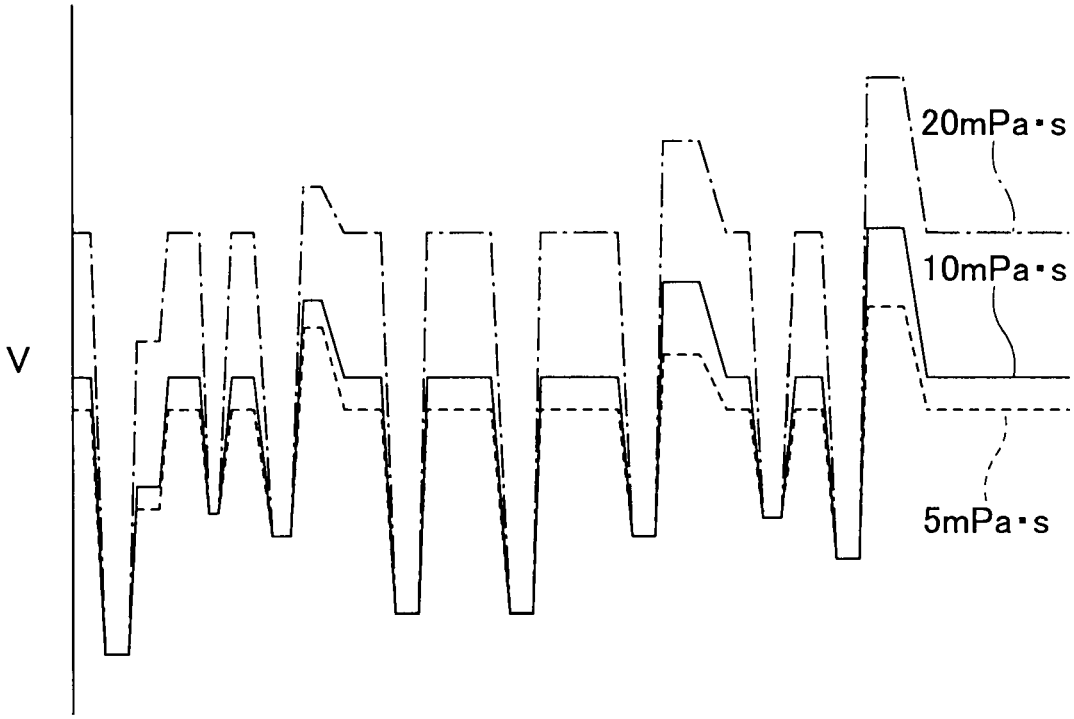
FIG. 9 illustrates differences in drive waveform depending on the viscosity of recording fluid.
Figure 10:
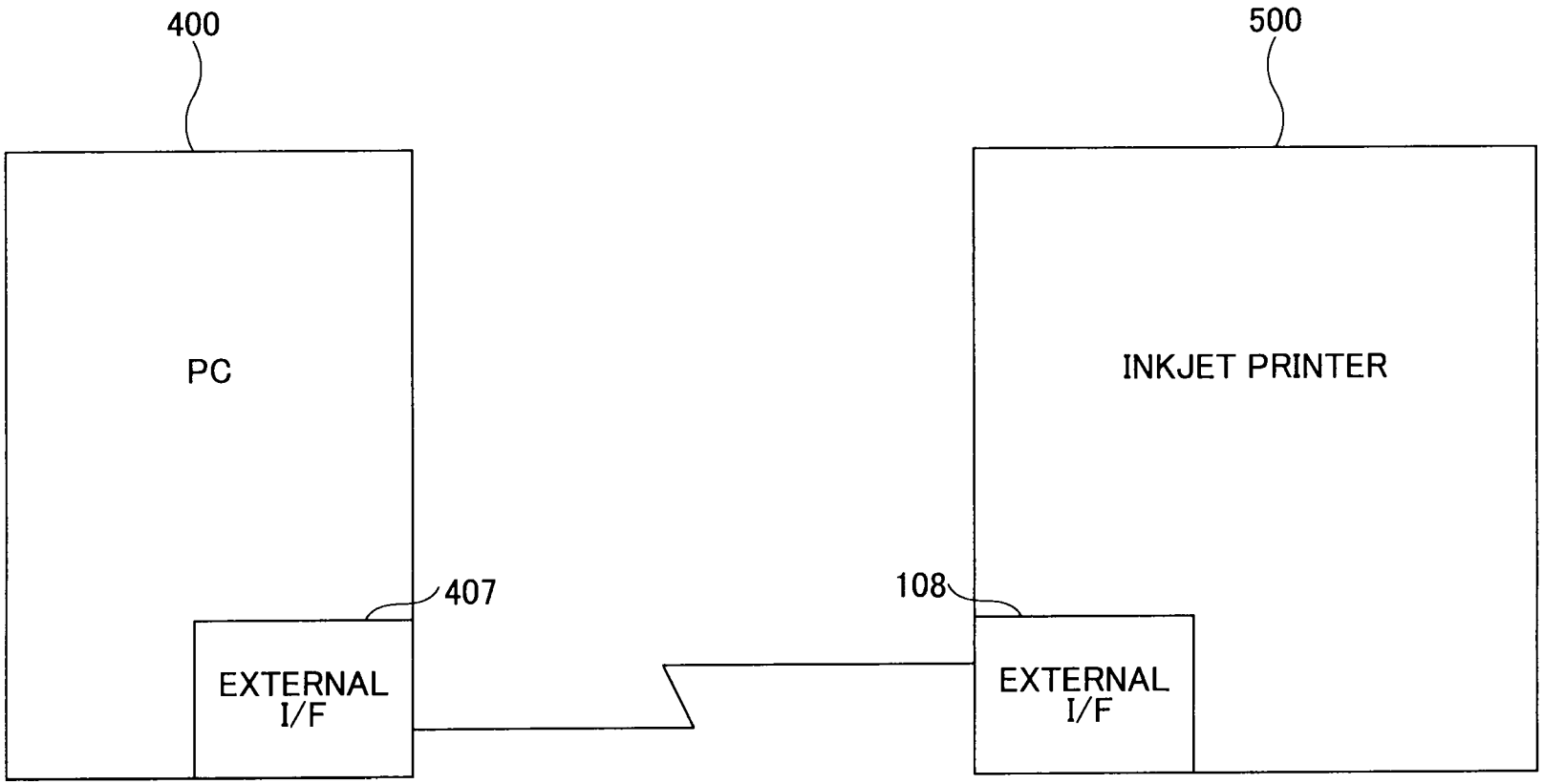
FIG. 10 is a block diagram of an image forming system including an image forming apparatus (inkjet printer) and an image processing apparatus (personal computer)

The required drive waveform may be varied depending on ink viscosity. Thus, in the image forming apparatus according to the present embodiment, a drive waveform for ink viscosity of 5 mPa·s, a drive waveform for ink viscosity of 10 mPa·s, and a drive waveform for ink viscosity of 20 mPa·s are prepared, as depicted in FIG. 9, and the drive waveform to be used is selected by determining the ink viscosity based on the temperature detected by the temperature sensor, for example. More specifically, the drive pulse voltage is reduced when ink viscosity is small, while the drive pulse voltage is increased when ink viscosity is large, so that the ink droplet can be discharged at substantially constant speed and volume regardless of ink viscosity (temperature). By selecting the crest value of the drive pulse in accordance with ink viscosity, oscillation of the meniscus can be obtained without discharging an ink droplet.

Thus, by using the drive waveforms consisting of the above-described drive pulses, the time it takes for a droplet of the various sizes (large, intermediate, or small) to land on a recording sheet can be controlled, thereby enabling multiple droplets to land at substantially the same position even when the droplets of the various sizes are discharged at different times.

Printing System

In the following, a printing system is described with reference to FIG. 11. In this printing system, an image forming program according to an embodiment of the present invention is stored in an image processing apparatus connected to an image forming apparatus. The image forming apparatus produces a printed image by executing the image forming program. The printing system includes an image processing apparatus 400, which may include a personal computer (PC), and an inkjet printer (image forming apparatus) 500. The image forming device 400 and the inkjet printer 500 may be connected via a predetermined interface or a network.

Figure 11:
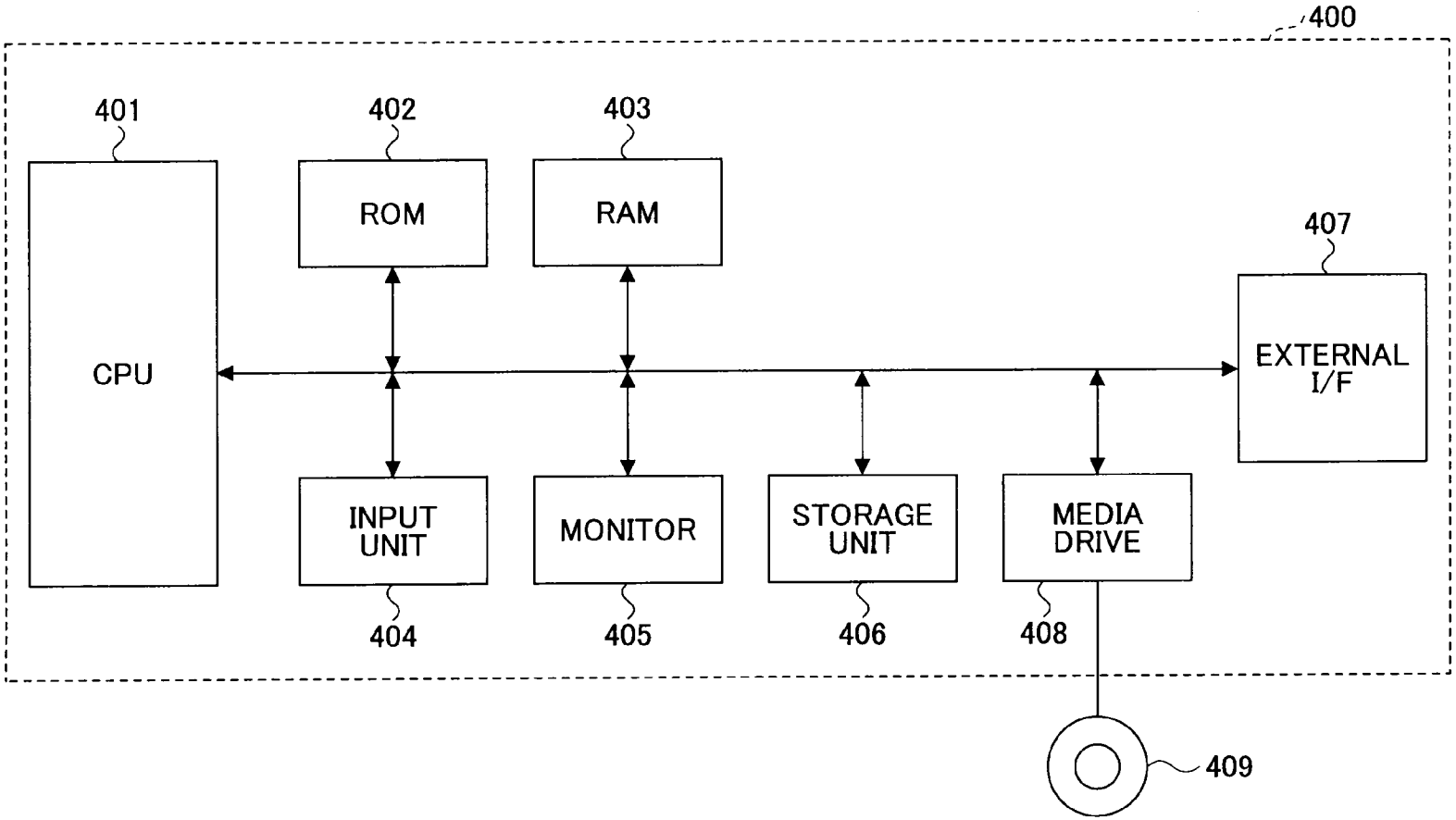
FIG. 11 is a block diagram of the image processing apparatus in the image forming system of FIG. 10.

Referring to FIG. 11, the image processing apparatus 400 includes a CPU 401 and various memory units, such as a ROM 402, and a RAM 403, which are connected via a bus line. The image processing apparatus 400 further includes a storage unit 406 which may include a magnetic storage unit such as a hard disk; an input device 404 which may include a mouse and keyboard; a monitor 405 which may include an LCD (liquid crystal display) or a CRT (cathode-ray tube); and a media drive 408 for reading a computer-readable print medium 409, such as an optical disk. These various units are also connected to the bus line via an appropriate interface technology. The image processing apparatus 400 also includes an external I/F 407 configured to enable communication with an external network, such as the Internet, or external equipment, such as a USB device.

An image processing program including the image forming program according to the present embodiment is stored in the storage unit 406 of the image processing apparatus 400. The image processing program may be read from the print medium 409 by the media drive 408 or downloaded via a network such as the Internet and then installed in the storage unit 406. Installation of the image processing program enables the image processing apparatus 400 to perform image processing described below. The image processing program may be run on a predetermined OS, or it may constitute a part of a software application.

While an image forming method according to an embodiment of the present invention may be performed by the inkjet printer 500, the inkjet printer 500 according to the present embodiment does not include the function of generating a dot pattern that is actually recorded in response to an image-rendering or character-printing instruction. For example, a print instruction issued from a software application and the like executed in the image processing apparatus 400 as a host is processed by a printer driver implemented in the image processing apparatus 400 as software in order to generate multi-value dot pattern data (print image data) that can be processed by the inkjet printer 500. The print image data is then rasterized and transferred to the inkjet printer 500, which produces a printed output based on the image data.

Specifically, in the image processing apparatus 400, an image-rendering or character-recording instruction from an application or the OS (the instruction specifying the position, thickness, and/or shape of a line to be recorded, or the font, size, and/or position of a character to be recorded, for example) is temporarily stored in an image-rendering data memory. Such an instruction may be described in a particular print language.

The instruction stored in the image-rendering data memory is interpreted by a rasterizer. If the instruction is a line-recording instruction, a recorded dot pattern is generated in accordance with the designated position or thickness. If the instruction is a character recording instruction, corresponding character outline information is called from font outline data stored in the image processing apparatus 400, and a recorded dot pattern is generated in accordance with the designated position or size. If the instruction involves image data, the image data is converted into a recorded dot pattern.

Thereafter, the recorded dot pattern is subjected to image processing and then stored in a raster data memory. At this time, the image processing apparatus 400 may rasterize the recorded dot pattern data with reference to an orthogonal grid as a basic recording position. The image processing may involve a color management process for adjusting colors using a CMM (color management module); a γ correction process; a halftone process using a dither method or an error diffusion method; a background removing process; and a total ink amount regulating process. The recorded dot pattern stored in the raster data memory is transferred via an interface to the inkjet printer 500.

2. Image Forming Method 2-1. Drive Frequency Control

An image forming method according to an embodiment may involve a "single-pass printing" operation or a "multi-pass printing" operation. The single-pass printing operation forms an image by performing a single main scan on the print medium. The multi-pass printing operation, on the other hand, involves forming an image by performing multiple main scans in the same region on the print medium a plurality of times, using the same group of nozzles or different groups of nozzles. Alternatively, a plurality of heads may be arranged in the main-scan direction so that the same region can be hit with ink droplets discharged from different nozzles. Such various recording methods may be used in various combinations as required.

Figure 12:
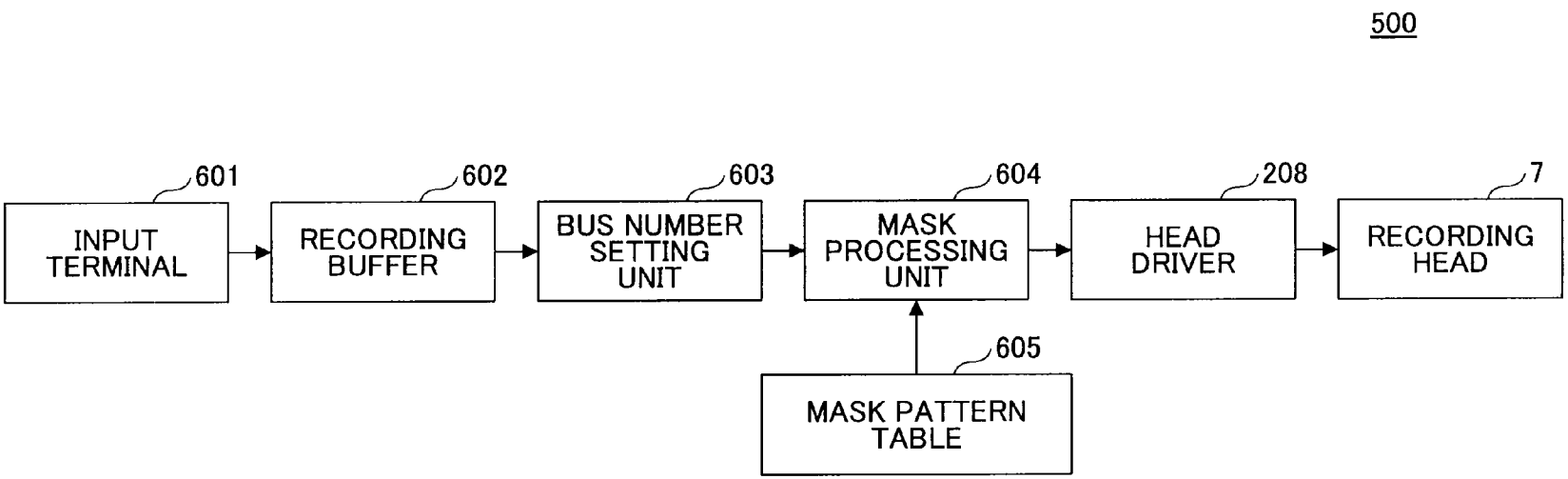
FIG. 12 is a block diagram of the image forming apparatus in the image forming system of FIG. 10.

In the following, a multi-pass printing operation is described in which four main recording scans (passes) are performed in a recorded region to complete an image. FIG. 12 is a block diagram of an image processing unit of the inkjet printer 500. Bitmap data is fed via an input terminal 601 and stored at a predetermined address in a recording buffer 602 under the control of a recording buffer control unit (not shown). The recording buffer 602 is capable of storing an amount of bitmap data corresponding to one scan and a unit sheet-feed amount. The recording buffer 602 may constitute a ring buffer similar to a FIFO memory configured to store data in sheet-feed amount units. When an amount of bitmap data corresponding to a single scan is stored in the recording buffer 602, the recording buffer control unit activates a printer engine, reads the bitmap data from the recording buffer 602 in accordance with the position of each nozzle of the recording head 7, and sends the bitmap data to a pass-number setting unit 603. When the bitmap data corresponding to the next scan is fed from the input terminal 601, the recording buffer control unit controls the recording buffer 602 so that the bitmap data can be stored in a vacant area in the recording buffer 602 (the area corresponding to the sheet-feed amount of which recording has been completed).

The pass-number setting unit 603 determines a division pass-number, and outputs the pass-number to the mask processing unit 604. A mask pattern table 605 contains mask patterns in advance for 1-pass recording, 2-pass recording, 4-pass recording, and 8-pass recording, for example. A required mask pattern is selected from the mask pattern table 605 depending on the determined division pass-number and outputted to the mask processing unit 604. The mask processing unit 604 masks the bitmap data stored in the recording buffer 602 using the selected mask pattern for the required-pass recording, and outputs the masked bitmap data to the head driver 208. The head driver 208 rearranges the masked bitmap data in the order of utilization by the recording head 7, and transfers the rearranged bitmap data to the recording head 7.

Thus, the multi-pass printing operation can make the banding phenomenon, which may be conspicuous in the case of a single-pass printing operation, less visible by averaging. While printing speed may be increased by the single-pass printing or by using a printer (generally, a line head type printer) having a head of a size greater than the width of the recording sheet, the single-pass printing method is subject to banding caused by an error in the sheet feed amount. Also, when a plurality of heads are arranged in the sub-scan direction so that a longer group of nozzles can be obtained, banding may be caused by a displacement at the joint portion of the heads.

Banding may be prevented by a method by which portions of the nozzles are overlapped. This method aims to distribute a dot displacement by distributing the print data among the individual nozzles. Specifically, the data is distributed among the nozzles for generating the dots to be printed based on the print data. In a printing method involving a plurality of scans, such distribution may include dividing and distributing data among the individual scans.

In such an overlap region, there may be two nozzles corresponding to a dot according to data. In this case, ink droplets would be discharged from the two nozzles to form the single dot according to data, thereby darkening the overlap region and creating banding unless some measure were taken. In one countermeasure, the print data for the overlap region is distributed among the nozzles using random numbers. However, the use of random numbers causes some nozzles to produce dots continuously and other nozzles to produce dots discontinuously. As a result, the overlap region may be printed with various drive frequencies. Because the drive waveform is designed so that a target discharge amount can be obtained when a droplet is discharged out of the nozzle at a predetermined drive frequency, the discharged amount varies depending on the drive frequency. For example, when the single-pass printing is changed to the two-pass printing, the drive frequency is divided in half. Thus, if the overlap region is printed with various drive frequencies, banding may be caused by the variation in the discharge droplet amount. Furthermore, drive frequency differences are also caused between the overlap region and the non-overlap region, thereby causing banding in the overlap region.

Figure 13:
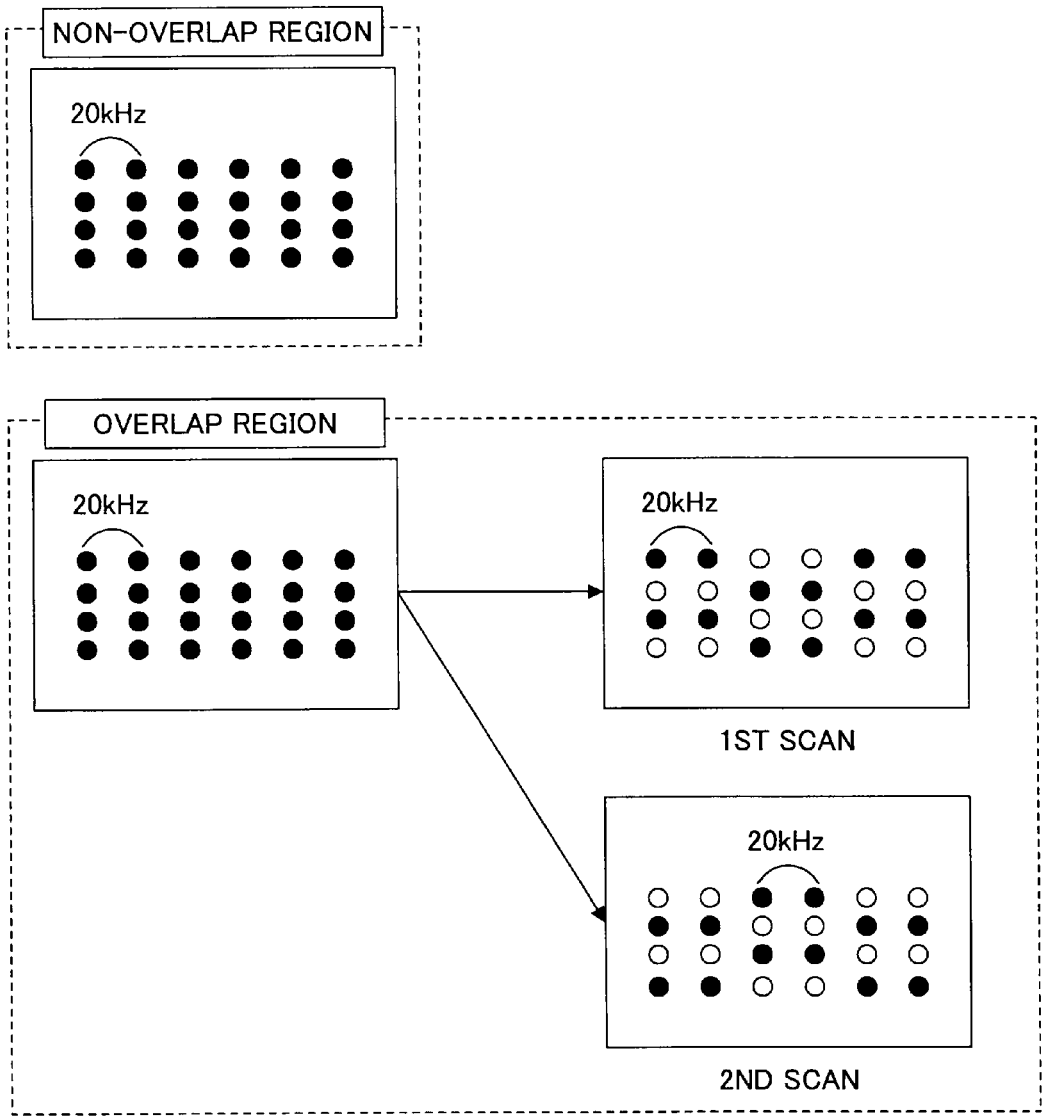
FIG. 13 illustrates a method for preventing banding by distributing print data to nozzles in each scan.

Development of banding can be prevented by, for example, distributing the print data to the nozzles during each scan so that the drive frequency of the overlap region is the same as the drive frequency of the non-overlap region, as depicted in FIG. 13, when distributing the print data for the overlap region. However, banding may become visible due to such uneven distribution of dots because, conventionally, banding due to dot displacement has been absorbed by dispersing the nozzles used in the overlap region.

Figure 14:
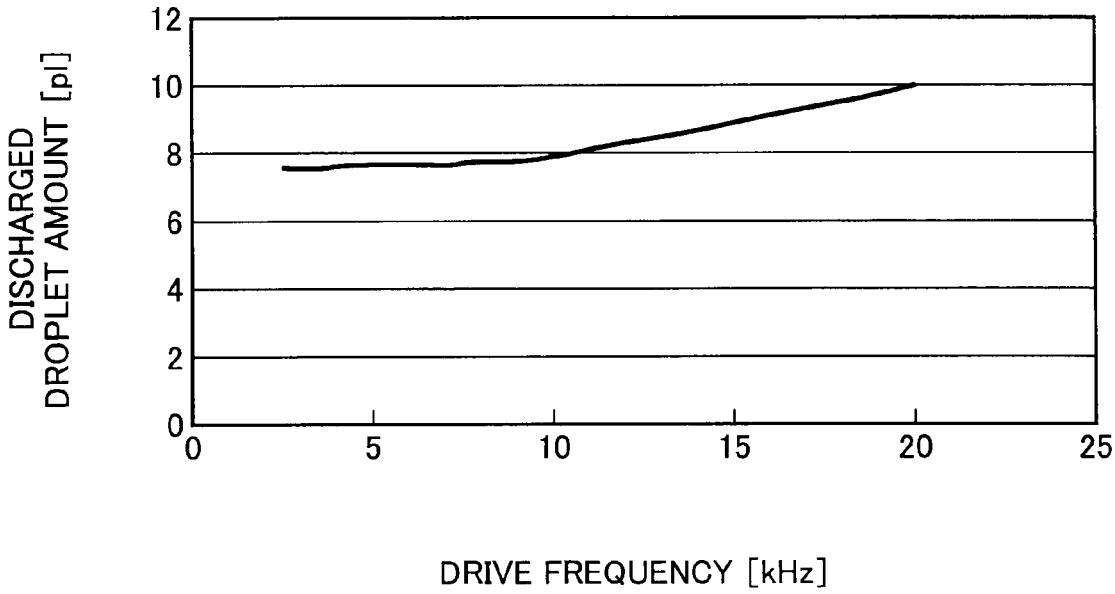
FIG. 14 is a graph plotting changes in discharged droplet amount against drive frequency.

The droplet-discharging drive frequency characteristics are described with reference to FIG. 14. FIG. 14 is a graph plotting the discharged droplet amount at drive frequencies from 5 kHz to 20 kHz. Single-pass printing has a drive frequency of 20 kHz; two-pass printing has a drive frequency of 10 kHz; and four-pass printing has a drive frequency of 5 kHz. Although the discharged droplet amount greatly changes from 20 kHz to 10 kHz, not much change in discharged droplet amount is seen from 10 kHz to 5 kHz. This means that in the case of single-pass printing, the influence of the frequency characteristics is large when the drive frequency of the non-overlap region is half that of the overlap region. Particularly, the influence of the frequency characteristics is pronounced in a shadow area where dots are produced to fill the area. In a highlight area where dots are sparsely produced, the influence is felt little because the drive frequency of the non-overlap region is lower.

Thus, it is preferable to distribute, using a print control unit, the print data depending on the gray level of image forming data so that the drive frequency in the overlap region is equal to the drive frequency in the non-overlap region. Specifically, the print data is distributed depending on the gray level so that the drive frequency is the same between the overlap region and the non-overlap region as regards the shadow area alone.

The frequency characteristics also vary depending on the viscosity of ink. Therefore, it is also preferable to distribute print data depending on the temperature around the recording head so that the drive frequency of the overlap region is equal to the drive frequency of the non-overlap region. Further preferably, the print data is distributed depending on the number of times of main scans in the same printed region so that the drive frequency of the overlap region becomes equal to the drive frequency of the non-overlap region. Specifically, because banding due to a difference in drive frequency is pronounced in the case of single-pass printing, the overlap region is distributed in a multi-scan mode, such as during two-pass printing.

As described above, the development of banding in the overlap region can be reduced by distributing the print data depending on a predetermined printing status, such as the gray level of image forming data, the temperature around the recording head, or the number of times of main scans in the same printed region so that the drive frequency of the overlap region is equal to the drive frequency of the non-overlap region.

2-2. Sheet Feed Amount Control and Print Data Shift Control

Ideally, the dot landing position should not be displaced in the sub-scan direction; in reality, however, the dot landing position may be displaced by mechanical displacement or variations in discharge stability. In the following, an image forming method according to an embodiment of the present invention is described by which the development of banding in the overlap region can be reduced when dots in the same main-scan line are displaced in the sub-scan direction. The image forming method involves a sheet feed amount control and a print data shift control, as will be described below.

Figure 15:
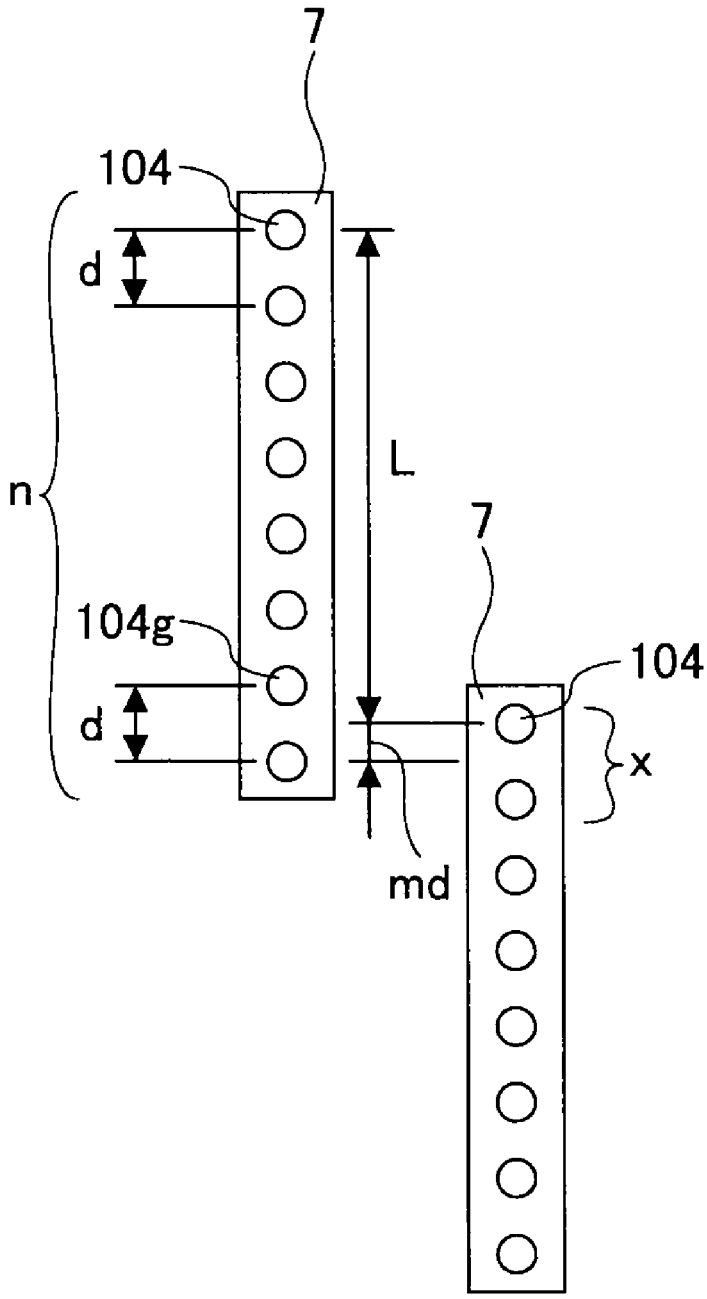
FIG. 15 illustrates a sheet feed control process.

FIG. 15 illustrates a sheet feed amount control operation according to an embodiment. In this operation, a sheet feed amount L is controlled so that the edge of the recording head 7 overlaps. Specifically, one or more nozzles (two nozzles in FIG. 15) on one end of the recording head 7 are designated as overlap control nozzles (which may be hereafter referred to as "overlap nozzles"), and a part of an image region (printed region) formed by a single main scan is designated as an overlap region. In the overlap region, an image is formed by multiple main scans ("overlap control"). Although FIGS. 15 and 16 illustrate two head portions 7 displaced in the main-scan direction, this is for the purpose of illustrating the sheet feed amount control, and in fact there is only one recording head 7, and the recording sheet is transported in the sub-scan direction.

In accordance with the present embodiment, the sheet feed amount L is determined by the following formula (for sheet feed amount control):

$$L=(n-x)d-md \quad (1)$$

where n is the number of nozzles in the recording head; x is the number of overlap nozzles; d is a nozzle pitch; and m is a feed correcting coefficient ($0 \leqq m \leqq 1$).

Increasing the number of overlap nozzles results in narrowing the area printed by a single main scan; therefore, an appropriate value should be selected for the number of overlap nozzles in the light of printing speed and the development of banding. The nozzle pitch d is the interval between adjacent nozzles (such as between the center of each nozzle).

In accordance with the present embodiment, the feed correcting coefficient m is set so that the dots in the same main-scan line are displaced in a direction in which the sheet feed amount becomes shorter ("minus (−) direction"). In this way, although a dark line may tend to appear with increased likelihood, banding becomes less visible because the lack of image is less than when the dots are displaced in the direction in which the sheet feed amount becomes greater ("+direction"). The feed correcting coefficient m ($0 \leqq m \leqq 1$) may be set as needed depending on the value of the nozzle pitch d, for example. Preferably, the feed correcting coefficient m is equal to or less than one-half pitch (d/2) (i.e., $m \leqq 0.5$).

Preferably, in addition to controlling the sheet feed amount, the drive frequency may be controlled. In this case, banding is even less likely to be recognized because the density of the overlap region decreases due to the decrease in the discharged droplet amount based on the frequency characteristics of the overlap region.

However, the above-described sheet feed amount control may still be unable to eliminate the displacement of dots in the overlap region because of variations in the sheet feed amount due to external factors, such as environmental changes over time, for example. Thus, a control operation is preferably performed when the sheet feed amount is displaced in the +direction, as described below with reference to FIG. 16A through 16C. In this embodiment, the nozzle at the end of the recording head 7 on the overlap region side (at the top in FIG. 16A) is not used during normal printing. More than one nozzle may not be used during normal printing. The opposite side to the overlap region may be referred to as a non-overlap side (at the bottom in FIG. 16A through 16C).

Figure 16A:
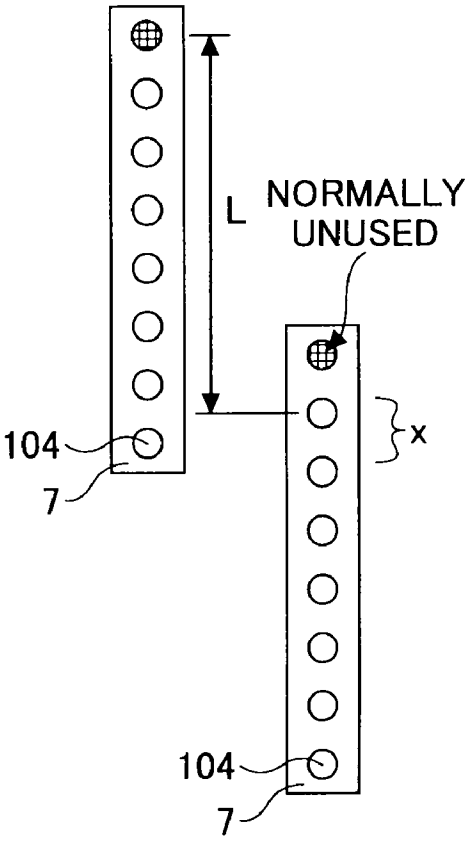
FIGS. 16A through 16C illustrate a print data shift control process.

Referring to FIG. 16A, the nozzle at the end on the overlap region side is normally unused, so that the second nozzle from the top corresponds to the head of print data. If the dots in the same main-scan line are displaced in the +direction due to variations in the sheet feed amount or the head mounted position, as illustrated in FIG. 17B, the data for the nozzles can be shifted toward the overlap region side so that the unused nozzle is at the head of the print data. In this way, the dots in the same main-scan line can be moved in the −direction.

Specifically, the print data for the nozzles is shifted to the overlap region side when the sheet feed amount L exceeds the following:

$$L=(n-x)d \quad (2)$$

where n is the number of nozzles in the recording head, x is the number of overlap nozzles, and d is the nozzle pitch.

Figure 16B:
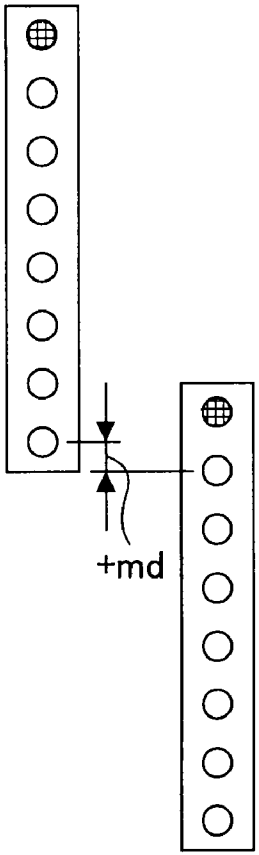
Figure 16C:
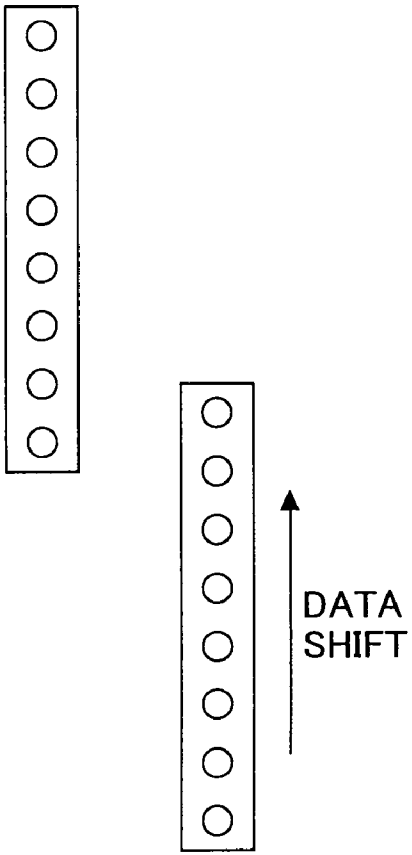

FIGS. 16A, 16B, and 16C illustrate the case in which the dots in the same main-scan line have been displaced in the +direction. On the other hand, if the dots in the same main-scan line are displaced in the −direction more than the nozzle pitch d, the data may be shifted in the downstream direction of the nozzles (i.e., toward the non-overlap region side). Thus, the unused nozzle may not be required in a configuration in which the above-described control is effected only when the dots in the same main-scan line are displaced in the −direction.

Preferably, the amount of displacement of dots in the overlap region is detected (measured) by a measuring unit in order to detect a variation in the feed amount, and whether or not the above-described shift control of print data should be performed may be determined using a determination unit. The measuring unit may include an optical sensor or a density sensor well known in the art. The determination unit may be provided by the CPU 201. Specifically, the CPU 201 may be configured to determine in which direction the nozzles should be shifted based on a result of measurement by the measuring unit, and then cause the print data shift control to be performed.

Further preferably, the amount of displacement of the dots in the overlap region are determined and expressed as a pattern (determination chart) that is outputted by an output unit to a reading unit or a user in a visible form. In this way, whether or not the print data shift control should be performed can be readily determined using the reading unit or by the user. By performing the measurement of the amount of displacement of dots by the measuring unit at scan intervals, the accuracy of determination by the determination unit can be improved and the print data shift control can be performed with increased accuracy.

Figure 17:
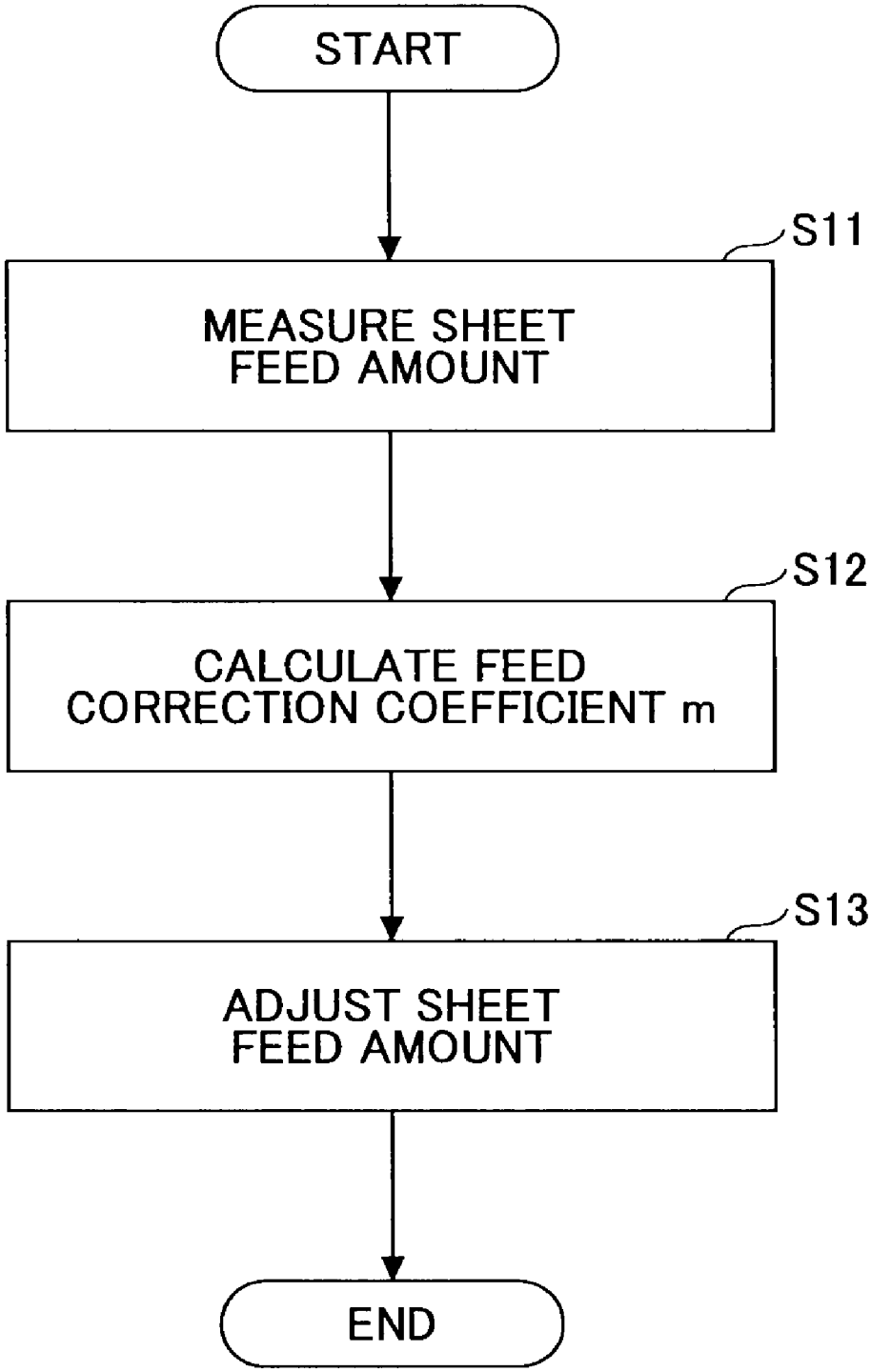
FIG. 17 is a flowchart of a sheet feed amount control process.

The sheet feed amount control and the print data shift control in the above-described image forming method may be performed by the CPU 201 functioning as a determination unit. Specifically, the CPU 201 may be configured to execute an image forming program to perform a process sequence which is described with reference to FIGS. 17 and 18. FIG. 17 is a flowchart of a process sequence of the sheet feed amount control. Referring to FIG. 17, the measuring unit detects the amount of displacement of dots in the overlap region in order to determine a recorded medium feed amount (step S11).

The CPU 201 then calculates the feed correcting coefficient m (step S12) in a range $0 \leqq m \leqq 1$ when the nozzle pitch d of the overlap region is set. For example, the value of the feed correcting coefficient m is set such that the nozzle pitch d of the overlap region is equal to or less than one-half pitch (d/2)(i.e., $m \leqq 0.5$). The CPU 201 then calculates the sheet feed amount L based on the number of nozzles n in the recording head, the number of overlap nozzles x, the nozzle pitch d, and the feed correcting coefficient m according to Equation (1), and controls the sheet feed amount in accordance with the value of L (step S13).

By such a sheet feed amount control, the nozzles in the same main-scan line in the overlap region are adjusted in the −direction. The feed correcting coefficient m may be controlled such that the scan line by the nozzle 104*g* of the recording head 7 illustrated in FIG. 15 is not exceeded in order to adjust the nozzle pitch d of the overlap region. Namely, in accordance with the sheet feed amount control method of the present embodiment, the feed correcting coefficient m is determined within a range such that the previous main-scan line is not exceeded.

Figure 18:
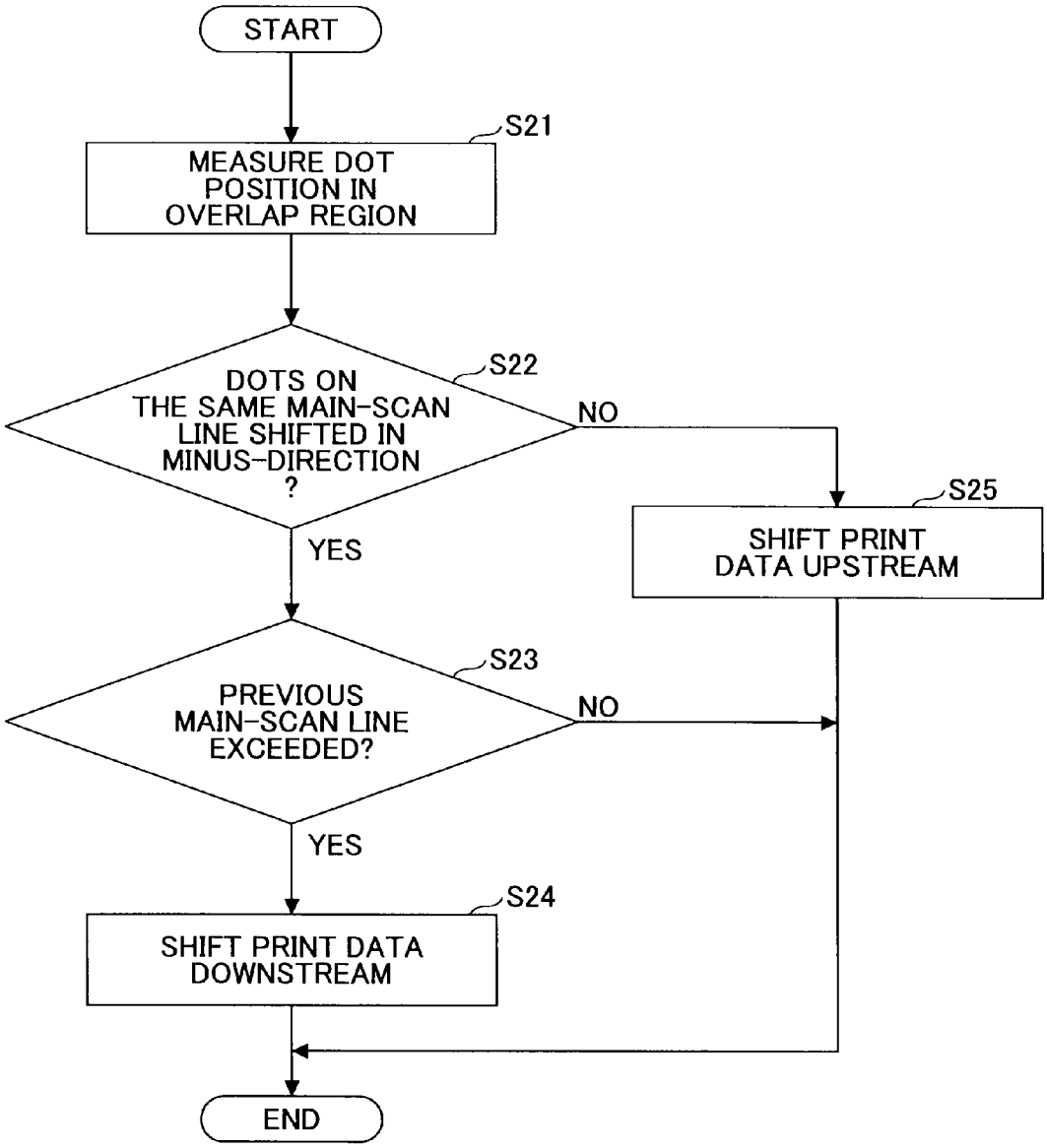
FIG. 18 is a flowchart of a print data shift control process.

FIG. 18 is a flowchart of a print data shift control process sequence. The measuring unit detects the amount of displacement of dots in the overlap region in order to measure the dot position in the overlap region (step S21). The CPU 201 then determines whether the dots in the same main-scan line in the overlap region are displaced in the −direction (step S22). If the dots are displaced in the +direction, the CPU 201 shifts the print data in the upstream direction, i.e., opposite to the sheet feed direction (sub-scan direction C in FIG. 2) (step S25), thereby completing the print data shift control process.

On the other hand, if the dots are displaced in the −direction, the CPU 201 determines whether the previous main-scan line is exceeded (step S23). If the previous main-scan line is not exceeded, the print data shift control process ends. If the previous main-scan line is exceeded, the print data is shifted in the downstream direction, i.e., the sheet feed direction (sub-scan direction C in FIG. 2) (step S24), thereby completing the print data shift control process.

2-3. Head Mounted Position Adjusting Control and Print Data Shift Control

Figure 19:
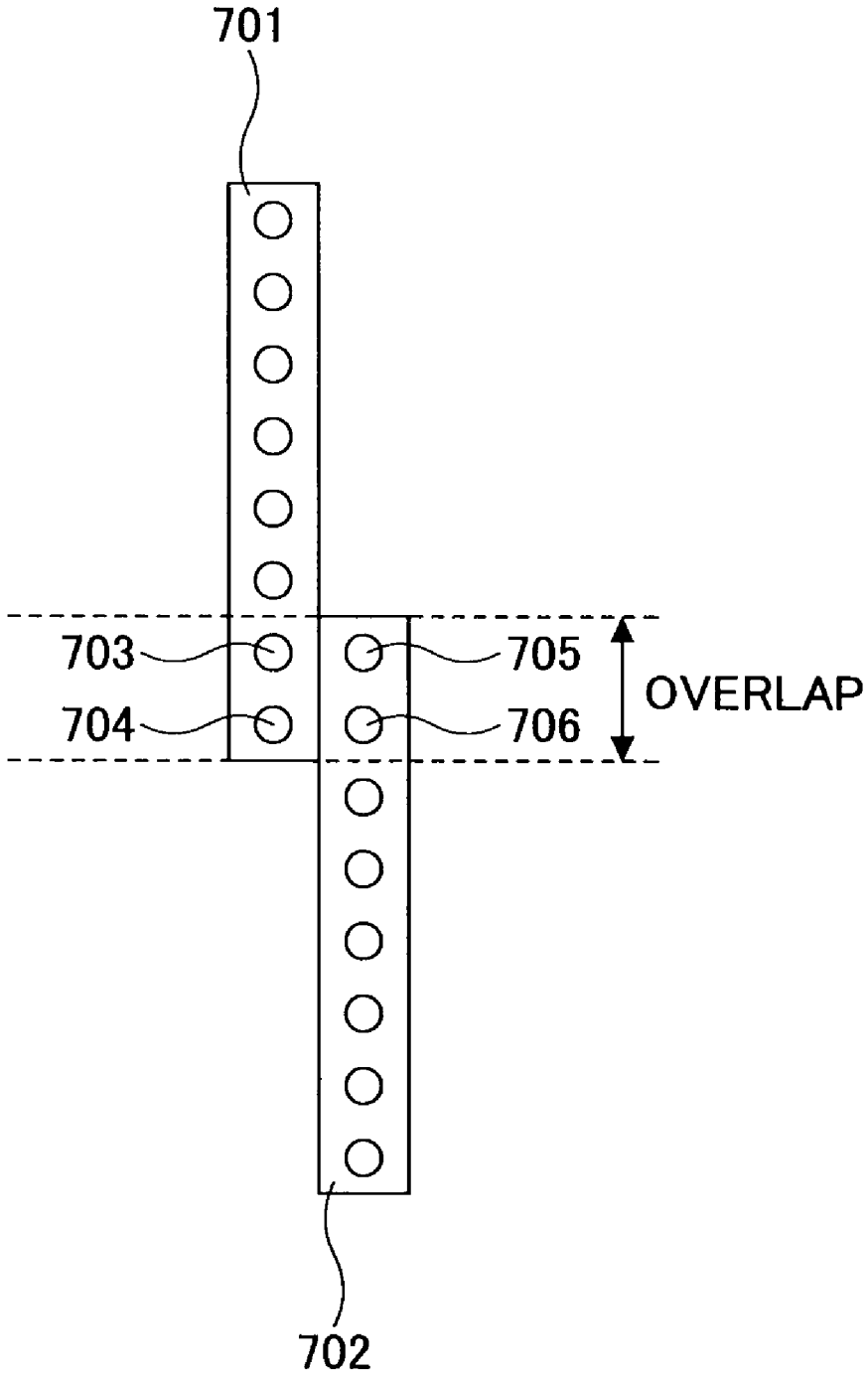
FIG. 19 illustrates a plurality of recording heads that are joined, forming a head-joint portion.

While the foregoing embodiment is directed to overlapping nozzles during sheet feed, an image forming method according to the present embodiment may be applied to a head-joint portion ("joint") in a case where a plurality of recording heads, such as recording head members 701 and 702 in FIG. 19, are joined for increased length. The image forming method may also be applied to a head joint portion in the case of a line printer. In these cases, the head mounted position is adjusted instead of the sheet feed amount.

Specifically, in accordance with the present embodiment, the recording head members 701 and 702 are joined such that the ends of the adjoining recording head members along the sub-scan direction form an overlap region. The corresponding nozzles (nozzles 703 through 706 in the example of FIG. 19) in the overlap region of the adjoining recording head members 701 and 702 are displaced in the direction in which the recording head becomes shorter ("−direction") by a maximum of the nozzle pitch d.

Preferably, as in the foregoing embodiment, the nozzle (such as the nozzle 705) at the edge of the recording head member (such as the recording head 702) in the overlap region side is not used during normal printing. In the event that the mounted position of the head-joint portion is shifted in the direction ("+direction") in which the recording head members 701 and 702 are separated by a distance greater than the nozzle pitch d due to external factors, such as environmental variations, the print data for the nozzles may be shifted in the upper-edge direction so that the nozzle at the edge is the first to print.

Further preferably, the print data for the nozzles may be shifted in the lower edge direction if the mounted position of the head-joint portion is shifted exceeding the value of H:

$$H = xd - md \tag{3}$$

wherein H is the mounted position of the head-joint portion; x is the number of overlap nozzles; d is the nozzle pitch; and m is a feed correcting coefficient ($0 \leqq m \leqq 1$).

As mentioned above, it is preferable to determine the amount of displacement using a measuring unit and a determination unit. Preferably, the drive frequency is also controlled. The above-described image forming method using an image forming apparatus may be performed by executing a program (image forming program) stored in a memory such as the ROM 202. Such an image forming program may be downloaded via the Internet to an information processing apparatus and then installed on the image forming apparatus. Alternatively, the image forming program may be executed by a printer driver in the information processing apparatus. In an embodiment of the present invention, the image forming program may be recorded in the computer-readable print medium 409 and read by the media drive 408 into the image forming apparatus.

Although the invention has been described with reference to particular examples, it will be appreciated by those skilled in the art that the invention may be embodied in many other forms. For example, it is to be appreciated that, while in the image forming apparatus of the foregoing embodiment, the recording head 7 is of piezoelectric type using a piezoelectric element, the recording head 7 may be of thermal type configured to discharge an ink droplet using an electrothermal conversion element based on film boiling. Such a piezoelectric head may be used to discharge droplets of different sizes using various drive waveforms, as described above, thereby facilitating the formation of a gray level image. On the other hand, the thermal head facilitates integration of nozzles, which is advantageous when printing a high-resolution image at high speed.

Examples of the thermal head include an edge-shooter type head and a side-shooter type head. The edge-shooter type head is advantageous in that the components of the head can be greatly reduced in size and still maintain high precision, the number of nozzles can be readily increased and their size can be easily reduced, and the head can be easily mass-produced.

The side-shooter type head has various structural advantages. For example, it allows the energy from a discharge energy generator to be efficiently converted into kinetic energy for forming an ink droplet and flying it, and the meniscus can stabilize fast upon supply of ink. The side-shooter type head is particularly effective when a heat-generating element is used in the discharge energy generator. Furthermore, the side-shooter system can avoid the problem of so-called cavitation phenomenon that is often encountered in edge-shooter systems, by which the discharge energy generator is gradually destroyed by the impact of air bubbles as they disappear. In a side-shooter system, air bubbles may grow but they are let out to the atmosphere once they reach the nozzle, so that no contraction of air bubbles due to temperature decrease occurs, thus extending the life of the head compared to an edge-shooter system.

Although this invention has been described in detail with reference to certain embodiments, variations and modifications exist within the scope and spirit of the invention as described and defined in the following claims.

The present application is based on the Japanese Priority Applications No. 2009-032223 filed Feb. 16, 2009 and No. 2009-285580 filed Dec. 16, 2009, the entire contents of which are hereby incorporated by reference.

What is claimed is:

1. An image forming method for an image forming apparatus having a recording head with a plurality of nozzles, comprising:

discharging a droplet of a recording fluid via the nozzles of the recording head onto a print medium;

performing a main scan in which the print medium is scanned by the recording head moving in a main scan direction;

performing a sub-scan in which the print medium is scanned by the recording head by moving the print medium in a sub-scan direction;

determining an overlap region in an image region formed by a single main scan;

performing an overlap control by forming an image in the overlap region through a plurality of main scans while the print medium is moved in the sub-scan direction by a feed amount L, wherein $L=(n-x)d-md$, where n is a number of the nozzles in the recording head, x is a number of the nozzles in the overlap region, d is a nozzle pitch, and m is a feed correcting coefficient ($0<m<1$);

determining a terminal nozzle at an end of the recording head on an overlap region side, the terminal nozzle configured to be not normally used; and shifting print data allocated to the nozzles toward the overlap region side in order to use the terminal nozzle when the feed amount L of the print medium is more than $(n-x)d$.

2. The image forming method according to claim 1, further comprising:

shifting print data allocated to the nozzles toward a non-overlap region side when the feed amount L of the print medium is less than $(n-x)d-md$.

3. The image forming method according to claim 1, further comprising:

measuring an amount of displacement of a dot in the image formed in the overlap region by the plurality of main scans; and determining whether the print data allocated to the nozzles should be shifted based on a result of the measuring.

4. The image forming method according to claim 3, wherein the determination of whether the print data allocated to the nozzles should be shifted based on a result of the measuring is made at scan intervals.

5. The image forming method according to claim 1, further comprising allocating print data to the nozzles so that a drive frequency of the overlap region is equal to a drive frequency of a non-overlap region.

6. An image forming apparatus comprising:

a recording head having a plurality of nozzles configured to discharge a droplet of a recording fluid onto a print medium;

a recording head scan unit configured to move the recording head in a main-scan direction;

a transport unit configured to transport the print medium in a sub-scan direction;

a terminal nozzle configured to be not normally used, the terminal nozzle being determined at an end of the recording head on an overlap region side; and a print control unit configured to perform an overlap control by forming an image in an overlap region of an image region formed by a single main scan of the recording head, wherein the image in the overlap region is formed by a plurality of main scans of the recording head by transporting the print medium in the sub-scan direction by a feed amount L, wherein $L=(n-x)d-md$ where n is a number of the nozzles in the recording head; x is a number of the nozzles in the overlap region; d is a nozzle pitch; and m is a feed correcting coefficient ($0<m<1$), and wherein print data allocated to the nozzles toward the overlap region side is shifted in order to use the terminal nozzle when the feed amount L of the print medium is more than $(n-x)d$.

* * * * *